US010555574B2

(12) United States Patent
Woo

(10) Patent No.: US 10,555,574 B2
(45) Date of Patent: Feb. 11, 2020

(54) SUNSHADE CAP WITH MULTIPLE RETRACTABLE SUNSHIELD MEMBERS

(71) Applicant: Frankie E. Woo, Whittier, CA (US)

(72) Inventor: Frankie E. Woo, Whittier, CA (US)

( * ) Notice: Subject to any disclaimer, the term of this patent is extended or adjusted under 35 U.S.C. 154(b) by 486 days.

(21) Appl. No.: 15/258,352

(22) Filed: Sep. 7, 2016

(65) Prior Publication Data

US 2016/0374420 A1 Dec. 29, 2016

Related U.S. Application Data

(62) Division of application No. 13/900,955, filed on May 23, 2013, now Pat. No. 9,439,466.

(51) Int. Cl.
*A42B 1/18* (2006.01)
*A42B 1/06* (2006.01)
*A41D 15/00* (2006.01)

(52) U.S. Cl.
CPC ..... *A42B 1/18* (2013.01); *A41D 15/00* (2013.01); *A42B 1/062* (2013.01); *A42B 1/067* (2013.01); *A41D 2300/324* (2013.01)

(58) Field of Classification Search
CPC ..... A42B 1/18; A42B 1/062; A42B 1/067; A42B 1/066; A42B 1/205; A42B 1/201; A42B 1/068; A42B 1/041; A42B 1/006; A42B 1/043; A42B 1/24; A42B 3/00; A42B 3/003; A41D 15/00; A41D 2300/324
See application file for complete search history.

(56) References Cited

U.S. PATENT DOCUMENTS

| | | | | |
|---|---|---|---|---|
| 1,050,310 A | | 1/1913 | Steinberg et al. | |
| 1,331,701 A | | 2/1920 | Fendelman | |
| 1,443,475 A | * | 1/1923 | Karus | A42B 1/066 2/172 |
| 1,486,853 A | * | 3/1924 | Barsky | A42B 1/066 2/172 |
| 1,697,507 A | * | 1/1929 | Karger | A42B 1/066 2/172 |
| 2,149,121 A | | 2/1939 | Kronenberger | |
| D141,256 S | | 5/1945 | Dannenberg | |
| 2,449,633 A | | 9/1948 | Albert | |

(Continued)

FOREIGN PATENT DOCUMENTS

| | | |
|---|---|---|
| CN | 2016062701982440 | 6/2016 |
| CN | 104427895 B | 7/2017 |

*Primary Examiner* — Nathan E Durham
*Assistant Examiner* — Abby M Spatz

(57) ABSTRACT

A retractable sunshade cap includes a crown having a forwardly extending visor, three sunshield members, and fastening members. The bottom end of the sunshield members are permanently attached to the base of the crown using permanent fastening members or sewing stitches or other permanent attachment methods. Left and right sunshield members are disposed with their front ends attached near the front centerline of the crown so that they drape forwardly down the side of the visor. Rear sunshield member is disposed so that it drapes down from near the rear crown portion. Detachable fastening members are deployed to secure angled folded flaps that reduce the size of the sunshield members for storage, and are also deployed to secure portions of the sunshield members onto the crown near its vertex for independent retraction and targeted shading of the face and neck.

4 Claims, 14 Drawing Sheets

(56) References Cited

U.S. PATENT DOCUMENTS

| | | | | | |
|---|---|---|---|---|---|
| 2,462,258 | A | | 2/1949 | Dannenberg | |
| 2,500,982 | A | | 3/1950 | Fligel | |
| 2,844,822 | A | | 7/1958 | Persico et al. | |
| 2,869,134 | A | | 1/1959 | Milstein | |
| 2,878,479 | A | | 3/1959 | Schuessler | |
| 2,897,510 | A | | 8/1959 | Forbes-Robinson | |
| 4,486,903 | A | | 12/1984 | Krystal | |
| 4,821,341 | A | * | 4/1989 | Baptiste | A42B 1/062 2/10 |
| 4,845,782 | A | | 7/1989 | Gregg | |
| 4,980,928 | A | | 1/1991 | Ellis | |
| 5,003,639 | A | * | 4/1991 | White | A42B 1/18 2/195.1 |
| 5,035,004 | A | | 7/1991 | Koester | |
| 5,035,006 | A | | 7/1991 | Hetz et al. | |
| 5,046,195 | A | | 9/1991 | Koritan | |
| 5,062,163 | A | | 11/1991 | Avey | |
| 5,081,717 | A | | 1/1992 | Shedd et al. | |
| 5,153,943 | A | | 10/1992 | Clement | |
| 5,201,077 | A | | 4/1993 | Dondlinger | |
| 5,351,343 | A | | 10/1994 | Harbison | |
| 5,355,535 | A | | 10/1994 | Bruder | |
| 5,493,733 | A | | 2/1996 | Pospisil | |
| 5,623,732 | A | | 4/1997 | Olajide, Jr. | |
| D380,591 | S | | 7/1997 | Kessel | |
| 5,669,075 | A | * | 9/1997 | Weeks | A42B 1/062 2/172 |
| 5,694,647 | A | | 12/1997 | Crickmore | |
| 5,694,648 | A | | 12/1997 | Nucifora | |
| 5,790,986 | A | | 8/1998 | Hall | |
| 5,875,493 | A | | 3/1999 | MacDonald et al. | |
| 5,901,380 | A | | 5/1999 | Mishal | |
| 5,956,773 | A | | 9/1999 | Lamantia | |
| 6,079,052 | A | | 6/2000 | Veridiano | |
| 6,081,933 | A | * | 7/2000 | Partsch, IV | A42B 3/227 2/195.1 |
| 6,233,745 | B1 | | 5/2001 | Friesen | |
| 6,467,096 | B1 | * | 10/2002 | Coluccio | A42B 1/22 2/171 |
| 6,739,718 | B1 | * | 5/2004 | Jung | A42B 1/247 2/10 |
| 6,789,268 | B2 | | 9/2004 | Yan | |
| 6,802,083 | B2 | | 10/2004 | Yan | |
| 6,996,852 | B1 | | 2/2006 | Cabrera | |
| 7,240,372 | B2 | | 7/2007 | Larson | |
| D599,533 | S | | 9/2009 | Yun | |
| 8,024,818 | B1 | * | 9/2011 | Davenport | A42B 1/067 2/172 |
| 8,051,497 | B1 | | 11/2011 | Erhardt | |
| 9,439,466 | B2 | | 9/2016 | Woo | |
| 2004/0025306 | A1 | * | 2/2004 | Coffey | A44B 17/0035 24/114.05 |
| 2006/0168708 | A1 | | 8/2006 | Moshier | |

* cited by examiner

SUNSHADE CAP WITH MULTIPLE RETRACTABLE SUNSHIELD MEMBERS

CROSS-REFERENCE TO RELATED APPLICATIONS

This application claims the benefits of U.S. Provisional Patent Application No. 61/657,471, entitled "SHADE SYSTEM FOR SPORTS CAP" and filed Jun. 8, 2012, which is hereby incorporated by reference.

TECHNICAL FIELD

The invention relates to hats and caps, more particularly to a sunshade cap that includes a crown and an outwardly or horizontally extending visor, multiple retractable sunshield members for shading the wearer's neck, ears, and face from the sun, and fastening members for attaching sunshield members to the cap and securing them in various positions of deployment and retraction. At least one embodiment is relates to detachable weather guards.

BACKGROUND ART

There are many varieties of caps with a visor commonly worn today, including the popular baseball cap, trucker cap, golf cap, and army fatigue cap, with different features such as having 5 or 6 panels, mesh rear portion, curved or flat bill, high or low profile, structured or nonstructured front crown, dome crown or flatter crown, fitted or with a size adjuster, etc. Although these caps may provide shading of the eyes from the blazing sun, they typically offer little protection for the back of the neck, the ears, and the sides and forward portion of the face. It is well known that prolonged exposure to intense solar rays increases the risk of getting sunburns, age spots, wrinkles, skin cancer and other skin damage. Therefore, people who participate in outdoors activities like golfing, hiking, fishing, farming and attending outdoor sporting events are taking great risk of sun damage to their face and neck even if they wear a cap. One means of protecting the face and neck from the sun is to use sunblock lotion, which some people prefer to avoid because they are greasy and messy, often stain clothes, do not last for more than a short period of time, and may contain chemicals that could potentially harm the skin after prolonged usage.

Fortunately, there is an alternative. There is extensive prior art relating to the addition of flaps or sunshields to the cap that offer some shading relief to the neck, ears and face. Proper review of prior art requires noting several important features or characteristics that may determine the usability of the sunshade cap. One main feature is adequate shading coverage by having sufficiently large sunshields. This is important because people who are out in the sun for a prolonged period of time may desire shading of not just the neck or ears, but also the sides of the face. Another feature is retractability, which is the ability to store one or more sunshields away on the cap when they are not needed. This allows the wearer to continue to wear the cap without the shading deployed, and further relieves the wearer of the inconvenience of having to carry sunshields attachments around. Another feature is the ability of the sunshield to drape over the bill, which allows more shading coverage of the forward portion of the sides of the face, especially the cheeks. Still another feature is the ability of the sunshade cap to individually target particular areas for shading as desired, since sometimes only one side of the face or only the neck requires shading. A minor feature is detachability of the sunshield, which enable the wearer to remove sunshields when not needed, and also to swap them with other sunshields.

The following prior art discloses caps with retractable shading coverage to certain limited areas. U.S. Pat. No. 822,986 to Rochet (1906) describes a covering for the nape of the neck that is retractable on a cap featuring an inner and an outer crown, with the nape covering store on top of the inner crown. U.S. Pat. No. 2,844,822 to Persico et al. (1958) describes a neck shading piece for a cap that can be folded and retracted on the side of crown. Most prior art that disclose detachable shading to the back of the neck do not offer retractability, such as U.S. Pat. No. 5,046,095 to Koritan (1991). More recently, however, U.S. Pat. No. 8,024,818 to Davenport (2011) describes a detachable neck shading piece that is retractable by repeatedly folding and gathering the shading piece until it forms a strip for securing to the back of the crown. For protecting only the ears, U.S. Pat. No. 723,946 to Tobias (1903) describes a cap with a portion that can be folded down over the ears, and that can be retracted by folding the portion either inside or outside of the cap. U.S. Pat. No. 5,351,343 to Harbison (1994) also describes a cap with earflaps that can be retracted using a cord lock, which requires that both flaps be deployed and retracted simultaneously. U.S. Pat. No. 4,486,903 to Krystal (1984) describes a cap with an inband that is stored on the underside of the head cover and folds down to cover the ears, which also requires that both ears to be covered simultaneous. Except for mostly earmuffs, such as U.S. Pat. No. 2,149,121 to Kronenberger (1939), there are few prior art examples of earflaps that can be independently deployed or retracted, such as U.S. Pat. No. 5,493,733 to Pospisil (1996) that describes earshading using a pair of elongated ear shades for the baseball cap.

Still other prior art discloses even greater sun protection to cover the nape of the neck, sides of the face and even the front of the face. U.S. Pat. No. 873,856 to Gordon (1907) describes a cap with one flap that protected the ears and the back of the neck, and another flap in front that included a goggle and nose guard, both retractable by folding them inside the crown, and U.S. Pat. No. 899,334 to Seitzman (1907) describes similar features. U.S. Pat. No. D141,256 to Dannenberg (1945) describes a cap with similar protective features except that the rear flap is retracted on top of the crown using fasteners disposed only on the flaps. U.S. Pat. No. 1,050,310 to Steinberg et al. (1911) describes a one-piece shading flap for the ears and neck that can be deployed by flipping the cap inside out. U.S. Pat. No. 1,331,701 to Fendelman (1919) describes a shield for the neck and side of the face, and another for the front of the face, both retractable on the inside of the cap. U.S. Pat. No. 2,449,633 to Albert (1948) describes a one-piece shading flap protecting the side of the face and neck that rolls up to a retracted position on top of the crown. U.S. Pat. No. 2,462,258 to Dannenberg (1949) describes variations of an earlier invented cap, this time using a baseball cap, wherein the rear flap covering the sides of the face and neck can be retracted either on the outside or inside. U.S. Pat. No. 2,897,510 to Forbes-Robinson (1959) describes a one-piece shading portion that can be retracted on the top of the crown by folding and securing with fasteners on top. U.S. Pat. No. 5,201,077 to Dondlinger (1993) describes a cap with one-piece detachable neck and face shield having its upper edge attached to the bottom back portion of the crown using loop and hook fasteners. For shading just the front of the face, U.S. Pat. No. 5,062,163 to Avey (1991) and U.S. Pat. No. 7,240,372 to Larson (2007) both disclose a hat or cap and a mask-like shading piece attached to it using releasable fasteners, but these caps are not retractable and also position the sunshield too close to the face to provide good ventilation.

There are numerous caps using a detachable sunshield, such as U.S. Pat. No. 5,153,943 to Clement (1992), which discloses a flexible weather-shield with an elastic band that can be affixed atop any hat having a forward visor and a rear size adjuster, but most of these caps are nonretractable. Exceptions include U.S. Pat. No. 5,623,732 to Olajide Jr. (1997), which discloses a cap with a retractable hood that is also detachable, but this is also a one-piece shading system, and U.S. Pat. Nos. 6,789,268 and 6,802,083 to Yan (2004), which both describe a cap and detachable shade portion that may be folded and stored inside an attachable pouch. The latter, offers more coverage to the front of the face because it comprises a central portion and two wing portions that can be wrapped around the rim of the cap near the front. Most of these above-described prior art inventions share the common problem of not being able to specifically target a particular area for shading, such as the back of the neck independent of the sides of the face or the ears, because they use a one-piece sunshield to cover these areas. In order to provide independent targeted shading, the cap would need to have multiple sunshields for covering the back of the neck and the sides of the face, such as U.S. Pat. No. 5,694,648 to Nucifora (1997), which describes a cap with multiple flaps that can be independently retracted into pockets with closure means located on the side portions of the crown. There are but a few prior art having multiple sunshields for the neck and side of the face to provide independent targeted shading, and that also share some similarities to the present invention, such as retraction of sunshields on the top surface of the crown and detachability and more, which will be discussed later on.

Many inventors have realized that shading of the forward portion of the face and cheeks is inadequate unless the shading flap drapes down from a portion of the visor or bill. There are numerous prior art disclosing a sunshield that are attached to the visor using fasteners on the visor, such as U.S. Pat. No. D380,591 to Kessel (1997), U.S. Pat. No. 5,901,380 to Mishal (1999), U.S. Pat. No. 6,996,852 to Cabrera (2006) and U.S. Pat. No. D599,533 to Yun (2009). However, since the visor is usually very stiff and thick, and covered with fabric, placing fasteners is very difficult to do and should be avoided. U.S. Pat. No. 2,869,134 to Milstein (1959) and U.S. Pat. No. 2,878,479 to Schuessler (1959) both describe a cap with a retractable flap draping from the rear of the side of the visor, thus revealing the possibility of draping a sunshield from the visor or bill without the need for fasteners on the visor. However, since both inventions do not place the forward ends of the flaps near the center of the front crown, the sunshield only drapes down from the rear of the visor and not from a forward position. Furthermore, the short longitudinal lengths of the flap on both caps results in insufficient shading to the lower part of the side of the face. U.S. Pat. No. 5,790,986 to Hall (1998) discloses a cap with one large sunshield that drapes from a forward position of the bill, and thus provides excellent sun protection to the forward portion of the face. U.S. Pat. No. 5,694,647 to Crickmore (1997) describes a flexible weather-shield accessory that can be placed on and removed from any headgear, such accessory including a visor-covering area that lies across the visor and drapes over it, thus extending coverage forward of the wearer's face. While these prior art benefit from not requiring fasteners on the visor, with some providing good face protection, they all use only one sunshield that does enable independent targeted shading of a particular side of the face or neck. Furthermore, these caps using a large sunshield for shading, especially one with an area much larger than the crown, are not retractable.

There are two prior art inventions that appears the closest to and shares many of the features of the present invention: retraction of sunshield on top of the crown, independent targeted shading, draping of the sunshield from a portion of the visor to shade more forwardly the side of the face, and detachability. U.S. Pat. No. 6,079,052 to Veridiano (2000) describes side sunshields that drape from the forward portion of the visor to provide shading along the sides of the face, particularly the front portion. The flaps are retractable and detachable, can be attached at various positions to adjust the shading coverage, and can be independent deployed. However, their attachments to the cap require placing fasteners on the visor, and also, there is no rear flap. U.S. application Ser. No. 11/049,148 by Moshier (2005) describes a cap with a pair of retractable side flaps that drape partially from the visor, and also a rear flap for protecting the neck that is retractable under the crown. There are several differences that distinguish these two prior art caps from the present invention. First, the prior art caps have sunshields that do not drape down over a forward part of the side of the visor. In Veridiano, even though the sunshields drape forwardly from the visor, they don't drape over the edge of the visor, but instead relies on fasteners on the underside of the visor to hold the forward portion of the sunshields. In Moshier, the flaps only drape from the rear of the visor. Second, both caps do not provide adequate shading because their sunshields are small, making them easier to retract onto the crown but less effective in shading the lower parts of the face, especially when the sun is shining from the side. The present invention uses sunshields that altogether exceed the area of the crown, and have greater longitudinal length, which enables them to drape lower down the side of the face. Third, both prior art caps do not have a rear sunshield that is retractable on top of the crown.

The following prior art relate to sunshields designed specifically for the front of the face under the eyes. U.S. Pat. No. 2,500,982 to Fligel (1950) describes a shield that attaches to a hooded coat using fasteners. U.S. Pat. No. 5,062,163 to Avey (1991), and U.S. Pat. No. 7,240,372 to Larson (2007) both describe a hat or cap and a mask-like shading piece attached to it using releasable fasteners, but these caps are not retractable, and they position the sunshield too close to the face to provide good ventilation. U.S. Pat. No. 5,035,006 to Hetz et al. (1991) describes a garment that can alternatively worn as an ascot, a neck warmer, a face and neck mask, or a visor, with two opposing side straps that extend outwardly from each of the side edges to wrap around the face, with loop and hook fasteners on the ends of the straps that interconnect. These prior art share the problem of the sunshield being worn like a mask, which might not be suitable for summertime use because placing the sunshield too close to the wearer's face without much ventilation could trap the warm breathe and make it too warm to wear for prolonged periods.

For prior art relating to a visor sleeve in one of the embodiment of this present invention, U.S. Pat. No. 5,956,773 to LaMantia (1999) describes a visor guard for covering the visor of a baseball-type cap, the guard comprising a pocket or sleeve defined by upper and lower panels, whose shapes generally conform to the shape of the bill to be covered. The sleeve is secured on the bill using a band connected to the edge of the lower panel that can be tucked under the inner sweatband of the cap. U.S. Pat. No. 6,081,933 to Partsch, IV (2000) discloses a helmet bill safety cover comprising of a crescent-shaped sleeve. The ends of an elastic strap are attached to the opposite sides of the sleeve so that the sleeve is slipped over the rigid bill of a helmet, and the strap is wrapped around the back of the helmet. U.S. Pat. No. 8,051,497 to Erhardt (2011) describes a shading apparatus that draped down over the side of the face and back of the neck, with a forward extending portion that has two pockets, one of which can be slipped over the visor or bill of a cap.

In summary, it is very difficult to find prior art that offer a shading cap that includes all of the following features: adequate shading protection, especially for the forward portion of the face, retractability, and independent targeted shading capability. Nor does prior art teach how to retract three large independently deployable sunshield members on top of the crown of the cap in a relatively neat manner. Also, prior art does not teach a cap having two side sunshields that drape down forwardly of the side of the visor to shade forwardly the side of the face without using any fasteners on the visor.

SUMMARY OF INVENTION

Technical Problem

The main objective of this present invention is to provide a cap with a shading system that offers the combination of the following features: sufficient shading coverage to the back of neck and sides of the face, especially the forward portion, retractability of the sunshields, and independent targeted shading. In order to achieve all of the above desired features in one sunshade cap, certain technical problems need to be overcome. First, independent targeted shading will require the use of at least three sunshields members, one for the back of the neck and one for each side of the face. Second, to provide adequate shading to the neck and face, the sunshield members need to be large enough to do the job, larger than the surface area of the crown itself, but the problem arises of how exactly to retract them onto the cap. The underside of the crown for storage has disadvantages in that sweat and greasy hair can quickly soil the sunshield members, so it is much more preferrable to store them on the exterior surface of the cap. Now the technical problem becomes how to retract three large flat fabric pieces onto a curved crown surface without the disorderly crumpling of the fabric that can often occur. Third, in order to protect the front side of the face, it is preferrable that the sunshield members drape down from the side of the visor, but the problem is how to drape the sunshield over the forward portion of the side without putting fasteners on the visor. Prior art primarily shows how to drap from the rear part of the visor. Finally, in order to enable independent targeted shading, there is the problem of how to secure each sunshield member in positions of deployment and retraction independent of whether the other sunshield members are deployed or retracted. So, all of these problems must be resolved simultaneous to fulfill the main objective.

There are other objectives that the various embodiments of this invention try to achieve. The second objective is to have at least one embodiment provide for detachability of the sun shields, primarily for decorative purposes of changing sunshield members with different colors or indicia, as well as allowing easier washing. The third objective of this invention is to have at least one embodiment provide that the sunshield members, when retracted, cover the entire crown of the cap for primarily decorative purposes of being able to change the color or look of the cap. The fourth objective is to have at least one embodiment of the invention provide ears shading as an independent targeted shading area, thus providing five separate target areas of coverage consisting of the back of the neck, left and right ear, and left and right side of the face. The fifth objective is to have at least one embodiment provide additional coverage to the front of the face below the eyes.

Solution to Problem

The exemplary embodiment, which resolves the problems associated with achieving the main objective, generally comprises of a cap with a rounded crown and a visor, a rear sunshield member, a left sunshield member, and a right sunshield member, and a plurality of snap fastener members disposed on the crown and on the three sunshield members. The three sunshield members are made substantially of flexible foldable fabric or fabric-like material, are quite large, and have predetermined shapes. The bottom end of the left and right sunshield members, at least a portion thereof, is attached to the base of the crown, with the forwardmost end of the sunshield members disposed near the center of the front crown portion, and the rearmost attachment generally disposed near the rear of the left and right crown portions respectively. There may be additional fastening attachments between the forwardmost and rearmost attachments. This configuration of the sunshield members and the snap fastener members enables the left and right sunshield members to drape down the forward portion of the side of the visor to shade forwardly the side of the face without the use of fasteners on the visor, and at an angle that also provides lateral shading all the way to the rear of the face. The bottom end of the rear sunshield member, at least a portion thereof, is attached to the base of the rear crown portion near either the rear end of the left and right crown portion, or the forward end of the rear crown portion. There is a plurality of attachments between these two end attachments, the number and position of which is dependent on the presence of a size adjuster. This allows the rear sunshield member to drape down the back to shade the back of the neck, and possibly the back of the ears. The large size of the three sunshield members provides ample shading coverage.

To solve the problem of how to store or retract three large sunshields members on top of the crown, the exemplary embodiment uses angled folded flaps on the sunshield members, formed by folding and pinching the fabric along fold lines that share the same focal point near a central region of the sunshield and extend toward the edges. This formation of angled folded flaps, and securing them with detachable fastening members, greatly reduces the area of the sunshields for contact with and storage on the exterior crown surface, and also transforms the sunshields from flat shapes into concave shapes somewhat matching the curved shape of the crown so as to minimize the crumpling of fabric.

Finally, to solve the problem of how to provide independent targeted shading such that one sunshield may be deployed or retracted regardless of whether the other sunshields are deployed or retracted, the exemplary embodiment uses a plurality of detachable fastening members disposed on the crown near the vertex of the crown for coupling with at least one detachable fastening member disposed adjacent to the front edge of each of left and right sunshield member, and with at least one detachable fastening member disposed near the top end of the rear sunshield member. In the exemplary embodiment, additional detachable fastening members enable the left and right sunshield members to be positioned in a different shading position to provide the wearer with a wider angle of view than the regular shading position.

The second objective for the sunshade cap of having detachable sunshields is also satisfied by the exemplary embodiment, which uses detachable plastic snap fasteners to attach the bottom end of the sunshield members to the bottom end of the crown. In an alternative exemplary embodiment, the sunshield members are permanently attached to the crown using permanent fastening members, which also has advantages. The third objective of the sunshield members covering the entire crown of the cap when retracted, primarily for decorative purposes such as changing the color of the crown by swapping in different sunshield members, is also satisfied by the exemplary embodiment. However, this objective is not a necessary one for the invention, and it is possible to have other embodiments that do not entirely cover the crown. The fourth objective of providing ear shading as an additional targeted shading area is also satisfied by the exemplary embodiment, by having the angled folded flaps of the right and left sunshield members turned downward so that they drape down below the bottom edge of the crown to provide shading for the ears. This deployed earflap position is then secured with detachable fastening members. Although the wearer would need to choose between deploying the sunshield to shade the side of the face or just the ears and cannot do both at the same time, the ability to deploy and retract the earflaps is not dependent on the deployment of the other sunshield members. However, other embodiments may omit earflaps.

Although the exemplary embodiment does not quite satisfy the fifth objective of providing the additional coverage of shading the front of the face below the eyes, especially when the sun is shining from the front, an additional exemplary embodiment does achieve this objective by adding a front sunshield member. This four-sunshield sunshade cap utilizes the same elements and features of the exemplary embodiment, and further comprises of a visor sleeve capable of slipping over the visor, detachable fastening members disposed on both ends of the front portion of the sleeve, and a sleeve flap member that is attached to the front portion of the sleeve near the sleeve opening that can be deployed and extended beyond the sleeve opening to expand the shading area of the front sunshield member. The detachable fastening members are used for coupling with existing and/or additional detachable fastening members disposed near the front edge of the left and right sunshield members for deployment of the front sunshield member so that it is positioned in front of the wearer's face, and for coupling with further included detachable fastening members disposed on the front crown for retraction. When the front sunshield member is deployed, the sleeve flap member is held in its upright position by a slight bending of the front sunshield member when it is attached to the left and right sunshield members, which causes the sleeve flap member to be sandwiched between the ends of the front portion and rear portion. In an additional embodiment, a strap is attached to each end of the front sunshield member, and detachable fastening members are disposed on the other end of the straps, for coupling with further included detachable fastening members on the front crown portion near the center, so that the straps drap down from each side of the visor to suspend the front sunshield in front of the wearer's face below the eyes. This enables the front sunshield member to be deployed independent of the left and right sunshield members.

Advantageous Effects of Invention

The advantage effects of this invention are that it includes many more useful features than prior art, including the following features:

1. The sunshade cap has three sunshield members that are retractable, so that the wearer need not deploy them all the time or carry them around for future use;
2. The sunshields are large enough to provide adequate shading for the back of the neck and the side of the face, not just the ears;
3. The sunshade cap is capable of independent targeted shading of the left side of the face, right side of the face and the back of the neck;
4. The left and right sunshield members are able to drape forwardly down over the side of the visor to provide shade forwardly the side of the face without fasteners on the visor;
5. The sunshield members, in at least one embodiment, are detachable, so they can be removed when not needed, or can be swapped with others of different colors or content;
6. The sunshade cap, in at least one embodiment, provides additional independent shading for the ears using the same left and right sunshield members;
7. In at least one embodiment, an additional sunshield member that is easily stored on the visor provides additional shading for the front of the face, particularly under the eyes;
8. The sunshade cap uses angled folded flaps that enable the sunshield members to be neatly stored on the top of the crown with minimal crumpling.

BRIEF DESCRIPTION OF DRAWINGS

FIG. 12 is a front perspective view of the cap body with attached rear sunshield member fully retracted, and with angled folded flaps tucked in.

DESCRIPTION OF EMBODIMENTS

While exemplary embodiments are described herein in sufficient detail to enable those skilled in the art to practice the invention, it should be understood that other embodiments may be realized and that logical changes may be made without departing from the spirit and scope of the invention. The following detailed description is presented for purposes of illustration only.

Figure 9:
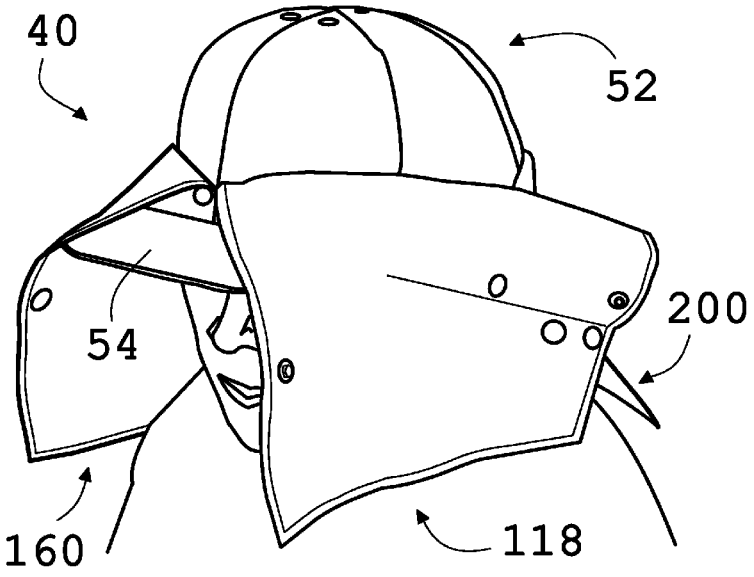
FIG. 9 is a front perspective view of a person wearing the sunshade cap.
Figure 10:
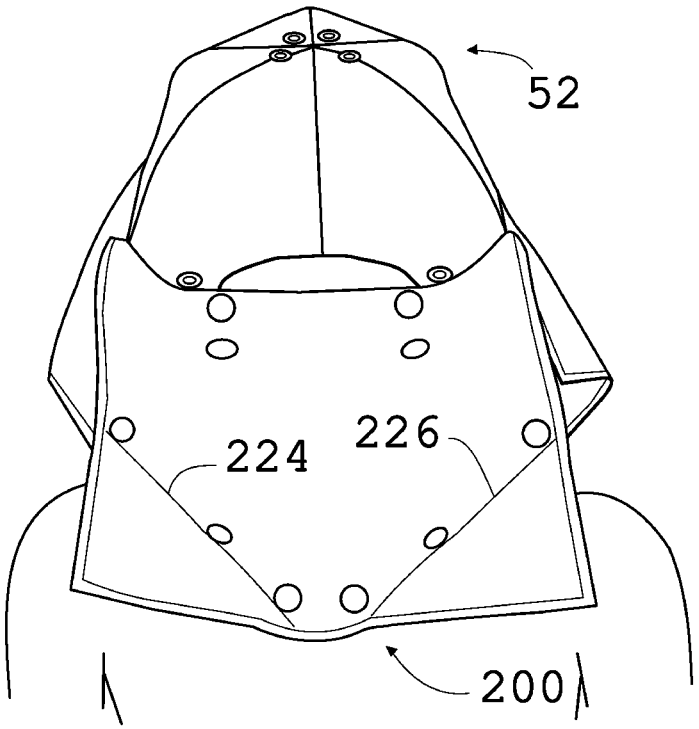
FIG. 10 is a rear perspective view of a person wearing the sunshade cap.

Referring first to FIG. 9 and FIG. 10, front and rear perspective views of an exemplary embodiment of a sunshade cap 40 being worn are generally shown. Sunshade cap 40 comprises a cap body 50 having a crown 52 and a visor 54, a left sunshield member 118, a right sunshield member 160, a rear sunshield member 200, and a plurality of fastening members, which will be individually referred to below, as each fastener serves one or more specific purposes. For the cap body 50, a baseball-style cap is used for the exemplary embodiment, but other types of caps may be used in the invention, including, but not limited to, golf cap, trucker cap, army fatigue cap, caps with crown partially consisting of mesh, and even hard hats.

Figure 1A:
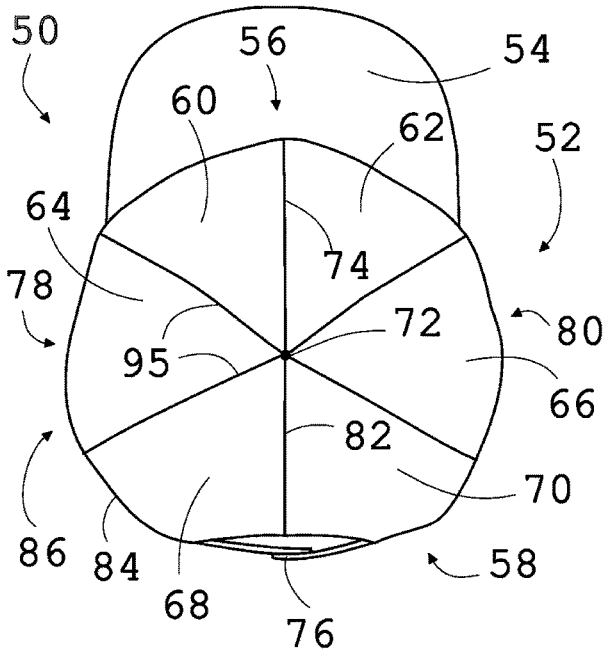
FIG. 1A is a top plan view of the exterior side of the cap used with the exemplary embodiment and FIG. 1B is a top plan view of the underside of the cap body.
Figure 1B:
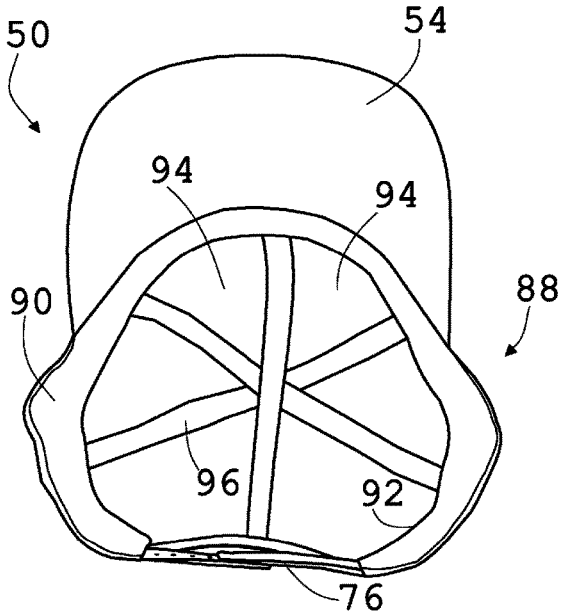

For the exemplary embodiment, FIG. 1A and FIG. 1B show the top and underside views of a 6-panel baseball-style cap body 50. Crown 52 has an exterior crown surface 86 and an interior crown surface 88, and includes a front crown portion 56, a rear crown portion 58, a left crown portion 78, a right crown portion 80, a vertex 72, a front centerline 74, a rear centerline 82, and a bottom crown edge 84. Specific to the 6-panel baseball cap, front crown portion 56 corresponds to combined left front panel 60 and right front panel 62; rear crown portion 58 corresponds to combined left rear panel 68 and right rear panel 70; left crown portion 78 corresponds to left side panel 64; and right crown portion 80 corresponds to right side panel 66. Visor 54, also called a bill, projects forwardly from near bottom crown edge 84 of and near front crown portion 56, typically but not necessarily touching the front end of the left and right side panels 64, 66. Although the exemplary embodiment as shown in the drawings uses a visor 54 of approximately 7.6 cm (3 inches) long measured at the center, it may be desireable for sunshade cap 40 to use a longer visor, up to an additional 7.6 cm (3 inches). Crown 50 may include a size adjuster 76 at rear crown portion 58 such as plastic snap adjusters or other types, eyelets holes (not shown) for ventilation, and a top button (not shown) placed at vertex 72, the topmost point of the crown, that are typical of baseball caps. However, these are not essential elements to the invention. It is preferrable that front crown portion 56 be of high profile so as to provide more surface area for storing sunshield members 118, 160 and 200, and that it be structured and stiffen by reinforcing left front panel 60 and right front panel 62 of the baseball cap with a stiff material, typically buckram backing 94, on interior crown surface 88. While front centerline 74 and rear centerline 82 may be visible on a 6-panel baseball cap as panel seams 95, they may not have visible manifestations for other types of cap. In the latter case, they may be viewed as an imagined longitudinal line serving as reference points, with front centerline 74, starting from bottom crown edge 84 at the center of front crown portion 56 up to vertex 72, and for rear centerline 82, from vertex 72 to the center of size adjuster 76, or, if that doesn't exist, to the bottom crown edge 84 at the center of rear crown portion 58. Interior crown surface 88 preferably may include a plurality of seam reinforcement strips 96 to protect the seams between panels, as certain fastening members may be positions on the seams, and also an inner sweatband 90 attached to the bottom crown edge 84 that includes a top sweatband edge 92 that is typically unattached to crown 52.

In this application, the term fastener or fastening member generally refers to two different groups of fastening components, one being a group of detachable or releasable fasteners and the other being a group of permanent fasteners. Detachable fastening members include, but are not limited to, plastic resin snaps, metal snaps, magnetic fasteners, magnetic snaps, hook and loop that may be a continuous strip, hoop and eye, buttons, latches and zippers. Permanent fastening members include, but are not limited to, stitches, glues and adhesives, staples, grommets, and rivets. In the various embodiments of the present invention, fasteners disposed in certain locations on sunshade cap 40 to serve one particular purpose need to be detachable, while fasteners disposed in other locations to serve another purpose may either be detachable or permanent. For purposes of reducing the number of independent and dependent claims in anticipated future patent filings, it is likely that one independent claim may include both the more general term fastening members to describe one broad set of fasteners that includes permanent and detachable fasteners, and the more specific terms detachable fastening members and permanent fastening members to describe a narrower set of fasteners.

Referring now to FIG. 2A to FIG. 2D, which show cap body 50 in four different perspective views, a plurality of detachable fastening members, more specifically plastic snap fasteners, are disposed at predetermined positions on crown 52. For the exemplary embodiment, plastic snap fasteners are preferred because they are easy to attach and detach, easy to secure onto fabric, will not heat up to high temperatures under the sun and burn the skin, unlike metal snaps, and typically come in different colors that can match the color of the cap or the sunshield members to make them less prominent, if that is desired. Snap fasteners generally have a male portion and a female portion that interlock and are detachable, with each portion also containing two part, front and back. While the coupling front part of the male and female snap members are different, they typically have the same back part, which appears round and flat when attached. In this application, any mention of a snap member facing a certain side means that the front part is facing that side. To secure a snap member, either male or female, to a piece of fabric, the fabric is squeezed between the front part and back part, such that the parts will be visible on the front and back side of the fabric respectively. In configuring the snap fasteners for coupling, the female portion, also herein referred to as female snap member, is typically disposed on stationary elements, while the male portion, also herein referred to as male snap member, is typically disposed on moving elements. Therefore, crown 52 should include mostly female snap members, and the sunshield members 118, 160, 200 should include mostly male snap members.

Figure 2A:
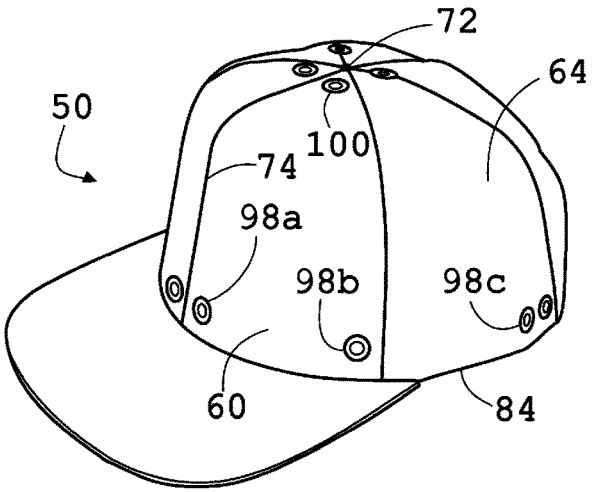
FIG. 2A and FIG. 2B are front left and right perspective views of the cap body with plastic snap fastening members.
Figure 2B:
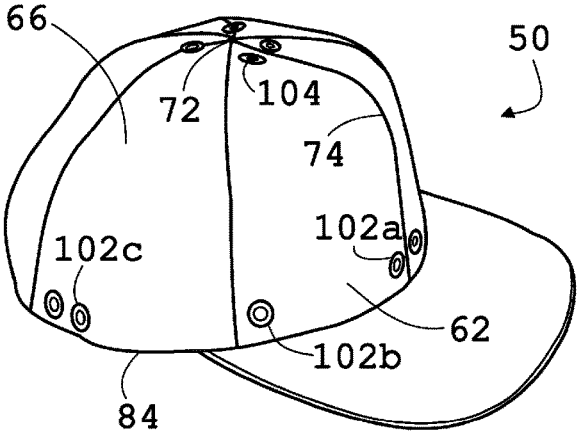

For attachment of the bottom end of left sunshield member 118 to crown 52 near bottom crown edge 84, a plurality of female snap members 98*a*, 98*b*, 98*c* are disposed adjacent to bottom crown edge 84 on left front panel 60 and left side panel 64. It is important that the forwardmost female snap member 98*a* is disposed adjacent to front centerline 74, as this enables left sunshield member 118 to drape forwardly down the side of visor 54. The rearmost female snap member 98*c* should be disposed past the center of left side panel 64 to allow a sufficient draping angle of the sunshield member to protect the rear end of the side of the face, and yet not so far rearward that it interferes with other functions or elements of the embodiment. As shown in FIG. 2A, the rearmost female snap member 98*c* is positioned close to but not adjacent to the rear end of left side panel 64, since that position is occupied by a female fastening member used for attaching rear sunshield member 200. To provide a more stable and secure attachment of sunshield member 118 to crown 52, a third female snap member 98*b* is disposed adjacent to the end of the left front panel. Similarly, for attachment of the bottom end of right sunshield member 160 to crown 52 near bottom crown edge 84, a plurality of female snap members 102*a*, 102*b*, and 102*c* are disposed adjacent to bottom crown edge 84 on right front panel 62 and right side panel 66. The forwardmost female snap member 102*a* is disposed adjacent to front centerline 74, and the rear-most female snap member 102*c* is disposed close to but not adjacent to the rear end of right side panel 66, as shown in FIG. 2B. A third female snap member 102*b* is disposed adjacent to the end of the right front panel. For retracting left sunshield member 118, female snap member 100 is disposed on left front panel 60 adjacent to front centerline 74 and near vertex 72. Similarly, for retracting right sunshield member 160, female snap member 104 is disposed on right front panel 62 adjacent to front centerline 74 and near vertex 72. Additional female snap members may be disposed along front centerline 74.

Figure 2C:
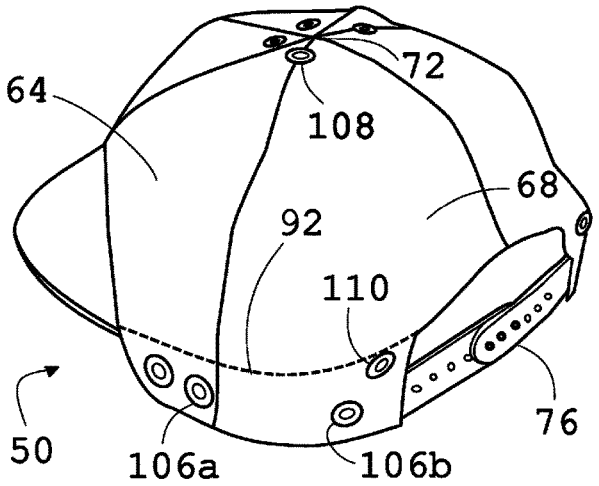
FIG. 2C and FIG. 2D are rear left and right perceptive views of same.
Figure 2D:
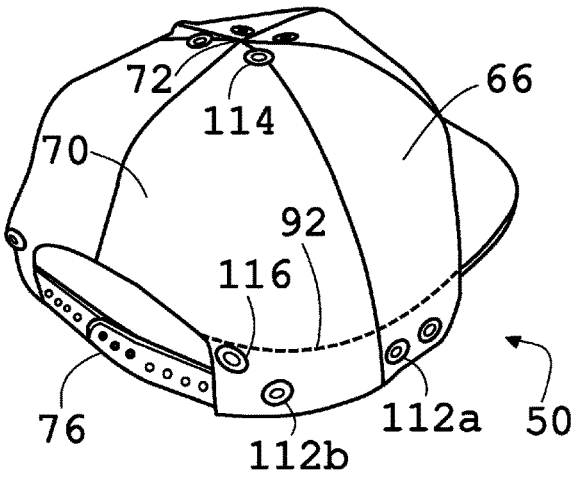

For attachment of the bottom end of rear sunshield member 200 to crown 52 near bottom crown edge 84, on the left side, female snap members 106*a* and 106*b* are disposed adjacent to bottom crown edge 84 adjacent to rear end of left side panel 64, and on left rear panel 68 adjacent to size adjuster 76, respectively, as shown in FIG. 2C. Additional female snap members may be added between the pair of snap members to accommodate changes in size adjuster 76 settings. If size adjuster 76, which is optional for the invention, is not present, additional snap members may be disposed where the size adjuster would have been. Placing the forwardmost female snap member 106*a* on left side panel 64 instead of on left rear panel 68 enables more shading coverage for the back of the ears. However, if that is not desired, the fastener may be placed on left rear panel 68. On the right side, female snap members 112*a* and 112*b* are disposed adjacent to bottom crown edge 84 adjacent to rear end of right side panel 66, and on right rear panel 70 adjacent to size adjuster 76, respectively, as shown in FIG. 2D. For retracting rear sunshield member 200, female snap members 108 and 114 are disposed near vertex 72, as shown in FIG. 2C and FIG. 2D, placed on panel seams 95 between side panels 64, 66 and rear panels 68, 70. Depending upon the configuration of rear sunshield member 200 in other embodiments, there may be just one female snap member placed near vertex 72 for attaching to rear sunshield member, or there may be more. To enable retraction of left and right sunshield members 118, 160 while the rear sunshield member 200 is deployed, female snap members 110 and 116 are disposed slightly above the ends of size adjuster 76, but below the height of the top sweatband edge 92 on interior crown surface 88, as inner sweatband 90 serves as a barrier preventing the hard back part of snap members from directly contacting or rubbing against the wearer's head. In this embodiment, all of the snap members disposed near the base of crown 52 are configured below top sweatband edge 92. Female snap members 100, 104, 108, 114 near the vertex have the potential for direct contact with wearer's head, but the high profile and structure of the cap should provide some clearance space. Nevertheless, extra padding made out of either soft fabric or stiffer material may be attached to interior crown surface 88 to cover any exposed snap members if plastic snap fasteners are used.

The exemplary embodiment includes three large sunshield members 118, 160, 200 that are attached to the cap body, as initially shown in FIG. 9 and FIG. 10. They should generally be made substantially of foldable flexible fabric or fabric-like material, such as cotton, especially twilled cotton fabric that works really well with baseball caps. Other materials may also be used, including, but not limited to, silk, wool, nylon, rayon, polyester, polyethylene, other synthetic materials, and/or blends of any of the above. Even electronic fabric-like materials are contemplated by the inventor, such as foldable solar cells, foldable OLEDs and thin fabric nanobatteries, as these revolutionary technologies may offer useful applications if incorporated into the present invention to take advantage of the sizeable coverage offered by the sunshield members. The sunshield members 118, 160, 200, are quite large, with a combined area generally greater than twice that of exterior crown surface 86. UV protection fabric may also be used in the sunshield members. Various hemming techniques known to person skill in the arts may be used to prevent fraying of the edges if the sunshield members are made of cloth or woven fabric, including, but not limited to, double roll hemming, blind hem, serged hem, and bias tape binding. The exemplary embodiment uses bias tape binding 130, shown in FIG. 3A, to hem the edges of the sunshield members, since that technique allows the edges to look the same on both sides.

Figure 3A:
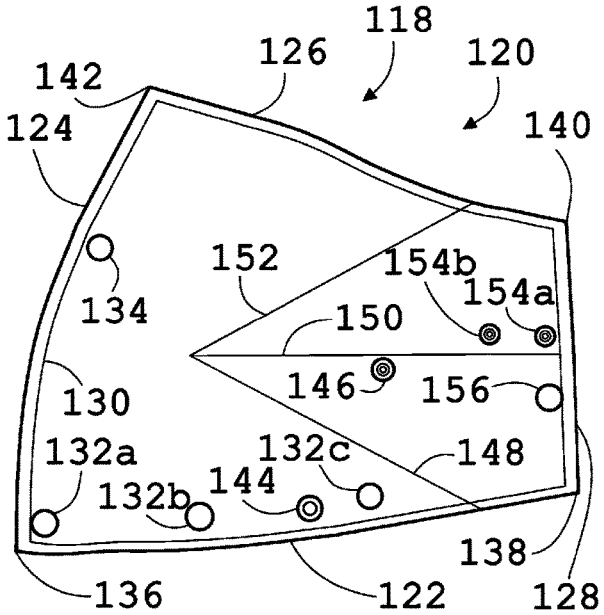
FIG. 3A and FIG. 3B are top plan views of the first and second side of the left sunshield member configured with plastic snap fastening members.
Figure 3B:
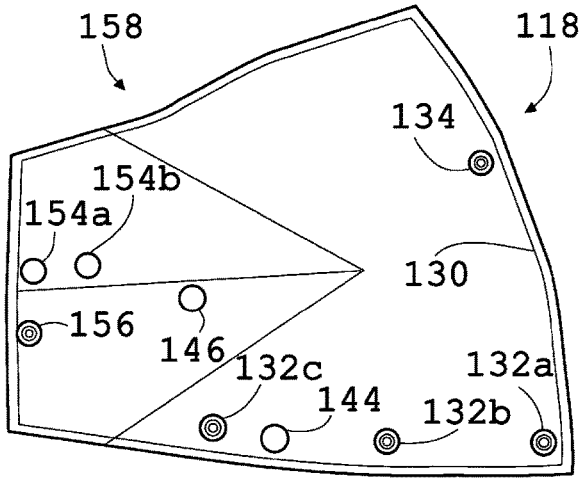
Figure 4A:
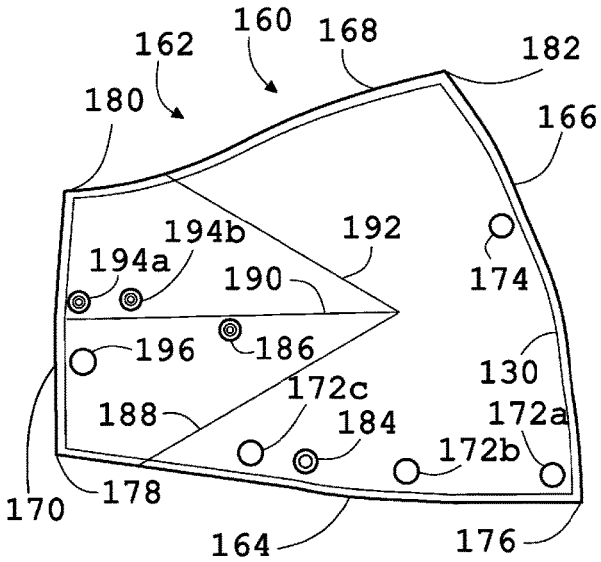
FIG. 4A and FIG. 4B are top plan views of the first and second side of the right sunshield member configured with plastic snap detachable fastening members.
Figure 4B:
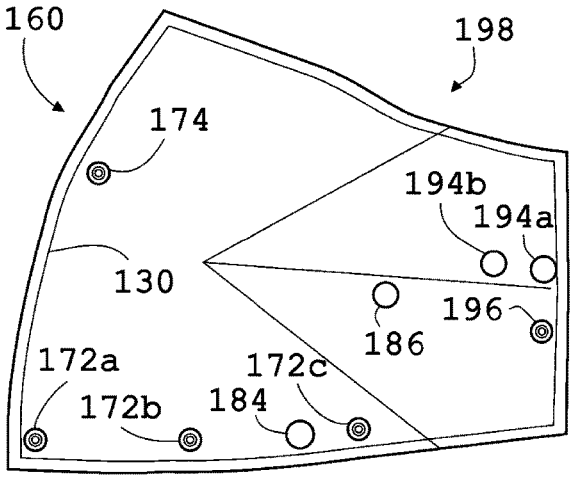

Left sunshield member 118 and right sunshield member 160 are mirror images of each other, so they will be described here together for the sake of brevity. Both left sunshield member 118 and right sunshield member 160 of the exemplary embodiment include a first side 120, 162, as shown in FIG. 3A and FIG. 4A respectively, and a second side 158, 198 as shown in FIG. 3B and FIG. 4B respectively. Both sunshield members further include a bottom edge 122, 164, a front edge 124, 166, a top edge 126, 168, a rear edge 128, 170, a front-bottom corner 136, 176, a rear-bottom corner 138, 178, a rear-top corner 140, 180, and a front-top corner 142, 182, and a plurality of plastic snap fastener members that are specifically referenced below. The shape of left and right sunshield members 118, 160 of the exemplary embodiment is not easy to describe, and so it is best to refer to the figures, which show a general shape suitable for a standard 6-panel high profile baseball cap. For this particular exemplary embodiment, bottom edge 122, 164 is roughly the distance of the bottom crown edge 84 from front centerline 74 to the ends of size adjuster 76, or approximately 2½ panel widths, and the length of front edge 124, 166 is approximately the distance of front centerline 74 from bottom crown edge 84 to vertex 72 plus around 7.6 cm (3 inches) additional length, which allows the sunshield members 118, 160 to drape down lower to cover the side of the face. Front-bottom corner 136, 176 should be initially at a 90 degree right angle, with bottom edge 122, 164 gradually curving upward and front edge 124, 166 gradually curving rearward. The degree and shape of the curvature of these edges, especially front edge 124, 166, depends on the particular cap and the shape of front crown portion 56, including whether it is high profile or low profile, and whether the top portion of crown 52 is flatter like an army fatigue cap or more dome-shaped like a baseball cap. Front-top corner 142, 182 is preferably at a right 90 degree angle, and top edge 126, 168 initially slopes downward straight, curves in the middle, and straightens out again before it reaches rear edge 128, 170. The rear edge 128, 170 is preferably straight, and the angle of rear-top corner 140, 180 should match angle of rear-bottom corner 138, 178, approximately 110 degrees but not necessarily so for other embodiments, since the rear portion of the sunshield will be folded so that these two corners come together to form angled folded flaps. Also, the rear portion of bottom edge share the same curve shape as the rear portion of top edge in mirror image so that when folded into each other, the edges line up to neatly form the flaps. For creating angled folded flaps, which are crucial to the retraction of left and right sunshields 118, 160, folds are created along certain fold lines, which may not be visible, although crease lines may begin to form after prolonged use of the cap. A first fold line 150, 190, starts at one end from the middle of rear edge 128, 170, preferably perpendicular to it, and continues laterally until it reaches a central location on sunshield member 118, 160 above female snap member 132*b*, 172*b*. Similar to radial or angled pleat folding, second fold line 152, 192 and third fold line 148, 188 begin near where first fold line 150, 190 ends so that all three fold lines share roughly the same focal point, with second fold line 152, 192 moving diagonally upward to meet top edge 126, 168, preferably but not necessarily at approximately 45 degree angle, and third fold line 148, 188 moving diagonally downward to meet bottom edge 122, 164, preferably at approximately 45 degree angle, a short distance rearward of the rearmost male snap member 132*c*, 172*c*. To help guide the beginner wearer in making folds, fold lines may be marked or printed on the sunshield members. However, the actually folds need not to be as precise as the figures depict, since fabric is not particularly easy to fold anyways, especially at sharp angles, and the configuration of snap fastening members generally help to guide the folding and to position the angled folded flaps.

Still referring to FIGS. 3A, 3B, 4A, and 4B, a plurality of plastic snap fasteners are installed on left and right sunshield members 118, 160, with some facing first side 120, 162 and some facing second side 158, 198, meaning that the male or female coupling part are only visible on that side. To enable attachment of at least a portion of the bottom end of left and right sunshield member 118, 160 to crown 52 near its bottom crown edge 84, a plurality of male snap members 132*a*, 132*b* and 132*c*, and 172*a*, 172*b*, and 172*c*, respectively, facing second side 158, 198, are disposed adjacent to bottom edge 122, 164, with the spacing between snap members matching the spacing of corresponding female snap members 98*a*, 98*b*, 98*c* and 102*a*, 102*b*, 102*c* disposed on crown 52. The longitudinal distance of the former group to bottom edge 122, 164 of sunshield members 118, 160 should match the distance of the latter group to bottom crown edge 84, so that both edges line up. The forwardmost male snap member 132*a*, 172*a* is disposed near front-bottom corner 136, 176 and adjacent to front edge 124, 166, so that the forward end of sunshield member 118, 160 abuts the front centerline 74 when attached. The rearmost male snap member 132*c*, 172*c* is disposed approximately two-thirds of the way toward rear edge 128, 170, and does not go beyond third fold line 148, 188 since the rear end portion of sunshield members 118, 160 will not be attached to crown 52. The middle male snap member 132*b*, 172*b* is disposed in between the other two to provide stability and security to the overall attachment of the sunshield members. The spacing between the forwardmost male snap member 132*a*, 172*a* and front edge 124, 166 generally matches the space between the forwardmost female snap member 98*a*, 102*a* on crown 52 and front centerline 74 so that the front edge 124, 166 abuts front centerline 74. Alternatively, the former spacing may exceed the latter spacing by a small distance, such as 0.15 cm or 0.30 cm (1/16 or 1/8 inch), so that when the female snap member 98*a*, 102*a* and male portion 132*a*, 172*a* are coupled, front edge 124, 166 lies slightly over front centerline 74, so that the opposing front edges 124, 166 of the sunshield members 118, 160 can lean against each other to form a small ridge, which helps to the seal any gap between the two front edges.

Configured for retracting sunshield members 118, 160, male snap member 134, 174 facing second side 158, 198 is disposed adjacent to the front edge 124, 166 at a distance from male snap member 132*a*, 172*a* that generally corresponds with the distance between female snap member 100, 104 on crown 52 and female snap member 98*a*, 102*a* located near vertex 72, ending well short of front-top corner 142, 182, approximately two-thirds of the way there, since front edge 124, 166 of sunshield members of the exemplary embodiment is approximately 7.6 cm (3 inches) longer than the distance from bottom crown edge 84 to vertex 72. Spacing of this male snap member 134, 174 to front edge 124, 166 should be such that the latter abuts front centerline 74 or forms a small ridge when the former is attached, and is generally similar to the spacing of male snap member 132*a*, 172*a*. Configured for securing earflap 274 shown in FIG. 22 in the deployed position, female snap member 144, 184 facing first side 120, 162, is disposed centrally adjacent to bottom edge 122, 164, and male snap member 146, 186 facing first side 120, 162 is disposed in a central region just below first fold line 150, 190. Other embodiments of this invention may omit earflaps, such as when the angled folded flaps are too short or when earflaps are not desired, in which case these snap members may not be needed. For retracting left and right side folded flaps 268, 270, a male snap member 154*a*, 194*a* facing first side 120, 162 is disposed adjacent to rear edge 128, 170 just above first fold line 150, 190, and another male snap member 154*b*, 194*b* facing first side 120, 162 is disposed just a short distance forwardly next to it. It is important to note here that other embodiments may have more than one folded flap on each of the sunshield members, or have them at different locations or with different lengths, in which case the detachable fastening members will need to be configured differently, in number as well as in location, to suit that particular embodiment in how the folded flaps are retracted. Finally, configured for changing the draping position of the sunshields, to enable a wider viewing mode, male snap member 156, 196 facing second side 158, 198 is disposed adjacent to rear edge 128, 170 and a short distance below first fold line 150, 190. Again, the configuration of this detachable fastening member is particular to this exemplary embodiment, and may vary in number and location in other embodiments.

Figure 11:
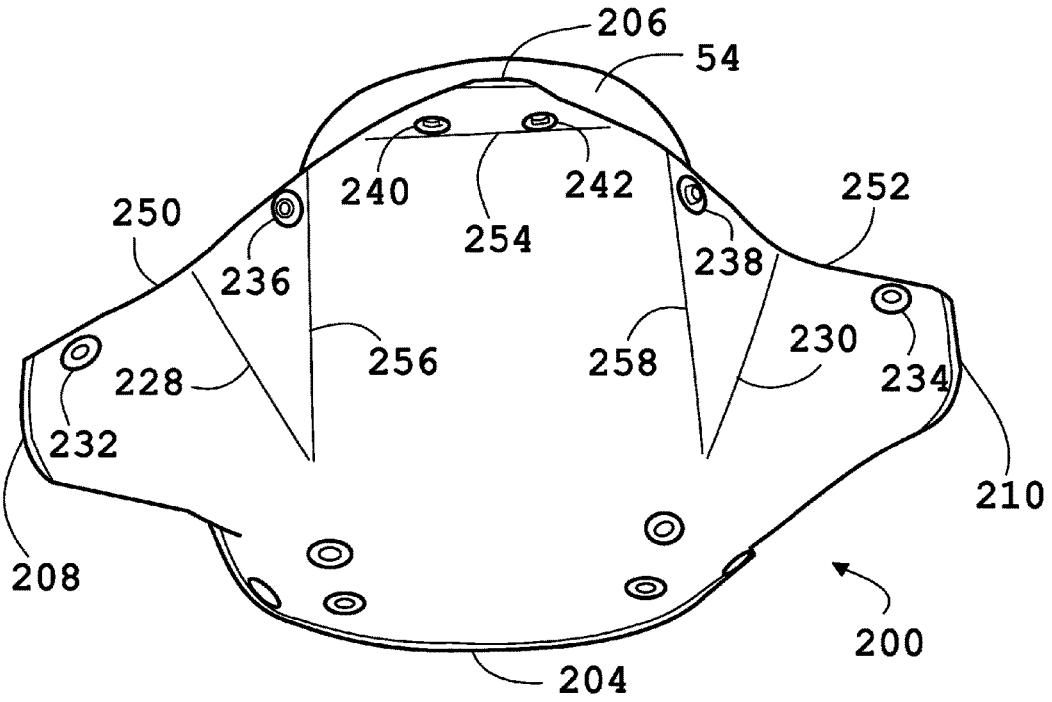
FIG. 11 is a rear perspective view of the cap body, with attached rear sunshield member with top corners folded in, and ready for further folding to achieve retraction.

Now referring to FIG. 5A and FIG. 5B, rear sunshield member 200 has a first side 202 and a second side 248, and includes a bottom edge 204, a top edge 206, a left edge 208, a right edge 210, a bottom-left corner 216, a bottom-right corner 218, a top-left corner 220, a top-right corner 222, and a plurality of plastic snap fastener members that are specifically referenced below. The shape of rear sunshield member 200 is relatively simple, a rectangular shape with dimensions approximately that of a sheet of 21.6 cm by 27.9 cm (8½ by 11 inches) letter-size paper, with the bottom and top edge 204, 206 being the longer edge. For point of reference purposes for positioning of snap fasteners, several fold lines need to be mentioned here. First, a left corner fold line 224 is located near the top-left corner 220, with one end starting near just above the middle of left edge 208 and the other end ending at top edge 206 just left of center, and a right corner fold line 226 is located near the top-right corner 222, with one end starting near just above the middle of right edge 210 and the other end ending at top edge 206 just right of center. Creating folds along these fold lines greatly reduce the area of the rear sunshield member for retraction. For creating angled folded flaps, left-side first fold line 228 and right-side first fold line 230 meet a lower part of left corner fold line 224 and right corner fold line 226, respectively, at right angles. Shown in FIG. 11, left-side second fold line 256 and right-side second fold line 258 sharing the same focal point in the central region as first fold lines 228, 230 are important for creating the angled folded flaps, serving also as an axis to guide the flaps toward their retracted positions.

Figure 5A:
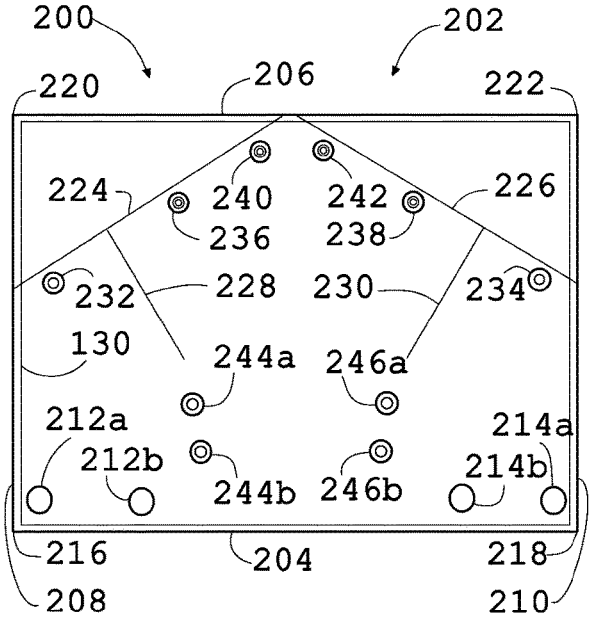
FIG. 5A and FIG. 5B are top plan views of the first and second side of the rear sunshield member configured with plastic snap fastening members.
Figure 5B:
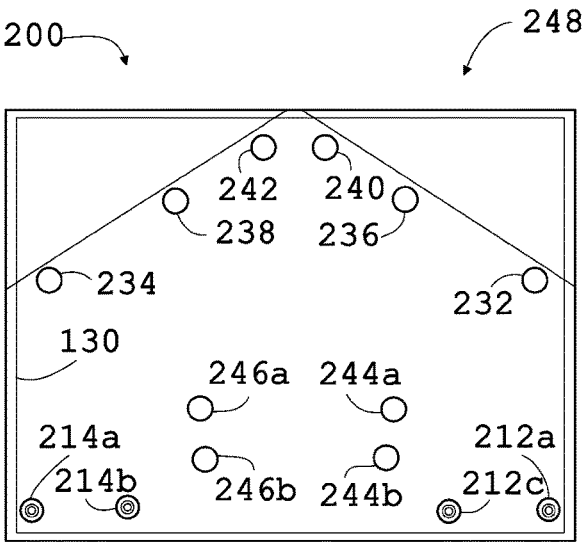

A plurality of plastic snap fasteners are configured on rear sunshield member 200, with some facing first side 202 and some facing second side 248, as shown in FIG. 5A and FIG. 5B. To enable attachment of at least portions of the bottom end of rear sunshield member 200 to crown 52 near its bottom crown edge 84, a plurality of male snap members 212*a*, 212*b* facing second side 248 are disposed on the left side adjacent to the bottom edge 204, and a plurality of male snap members 214*a* and 214*b* facing same side similarly are disposed on the right side, with the spacing between snap members matching the spacing of female snap members 106*a*, 106*b*, 112*a*, 112*b* on crown 52, and the vertical distances of the former group to bottom edge 204 matching the distance of latter group to bottom crown edge 84, so that both bottom edges line up. As shown in FIG. 5A, the leftmost male snap member 212*a* is disposed near and adjacent to bottom-left corner 216 and to left edge 208, with male snap member 212*b* disposed to the right of it matching the spacing between female snap members 106*a*, 106*b* on crown 52, and the rightmost male snap member 214*a* is disposed near and adjacent to the bottom-right corner 218 and right edge 210, with male snap member 214*b* disposed to the left of it matching the spacing between female snap members 112*a*, 112*b* on crown 52. Configured for retracting rear sunshield member 200 and attaching the top portion thereof to the top of crown 52 near vertex 72, male snap member 240 and 242 facing the first side is disposed just below the top end of left and right corner fold line 224 and 226 respectively, close to top edge 206 near the center thereof. Configured for securing inwardly facing angled folded flaps formed by pinching and folding along left-side and right-side first fold lines 228, 230, male snap members 236, 238 facing first side are disposed near the middle of and just under the left and right corner fold line 224, 226, respectively, and female snap members 232, 234 facing first side are also positioned under the corner fold lines near the left side 208 and right side 210 of rear sunshield member 200, respectively, and both male and female snap members should be of equal distance to left-side and right-side first fold lines 228, 234. Configured for retracting left and right sunshield members 118, 160, two pairs of female snap members 244*a*, 244*b* and 246*a*, 246*b* respectively, facing first side, are lined up vertically and disposed a short distance above and to the right of male snap member 212*b*, and above and to the left of male snap member 214*b*, respectively. The exact positioning depends on where male snap member 154*a* on left sunshield member 118, and male snap member 194*a* on right sunshield member 160, both disposed on folded flaps, make contact with rear sunshield member 200 in various positions of retraction. These female snap members may also be used to adjust the draping angle of the left and right sunshield member 118, 200. However, in some embodiments, angled folded flaps 268, 270 of the left and right sunshield members, shown in FIG. 16, may be so short they can be secured on the same sunshield member without attaching to rear sunshield member 200, in which case these fastening members may not be needed. It is important to note that this exemplary embodiment represents just one folding configuration. Other embodiments may use different folding configurations wherein the angled folded flaps may be folded outwardly instead of inwardly on rear sunshield member 200, or the number and positioning of the angled folded flaps may be different, which would then influence the number and placement of the detachable fastening members required.

Figure 6:
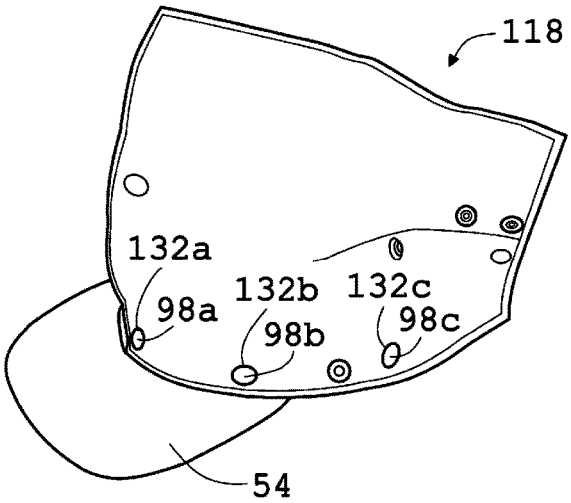
FIG. 6 is a front left perspective view of the left sunshield member held in an upright position as its bottom end is attached to near the bottom of the crown.
Figure 7:
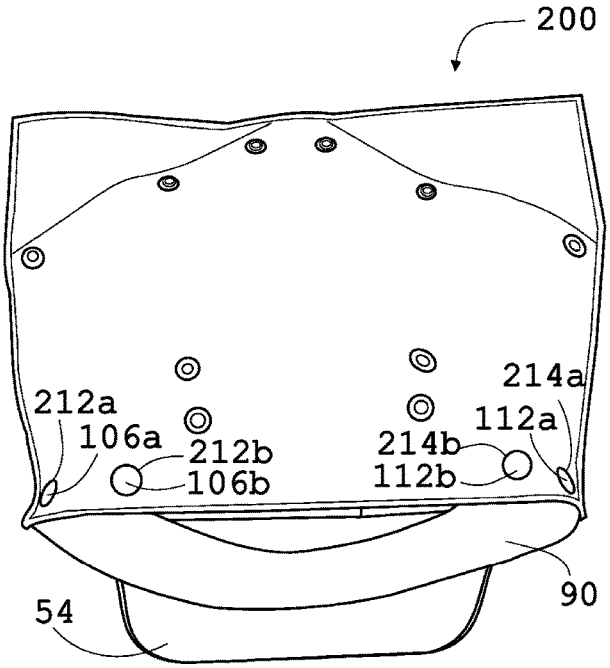
FIG. 7 is a rear perspective view of the rear sunshield member held in an upright position as its bottom end is attached to near the bottom edge of the crown.

Now that the essential elements of the exemplary embodiment have been described, the following explains how the exemplary embodiment operates. Please note that in order to avoid clutter in the drawings, some items discussed in the following description and referred to by reference number may not be shown with identifying reference number in the particular drawings being discuss, in which case those items with corresponding reference numbers may be found in FIG. 1A to FIG. 5B. FIG. 6 shows at least a front portion of the bottom end of left sunshield member 118 near its bottom edge 122 attaching to crown 52 near its bottom crown edge 84, with the forwardmost end previously described as front-bottom corner 136 abutting front centerline 74. With second side 158 of sunshield member 118 facing crown 52, male snap members 132*a*, 132*b*, 132*c* disposed on left sunshield member 118 are coupled with female snap members 98*a*, 98*b*, 98*c* disposed on crown 52 respectively. Even though the last coupling between male and female snap members 132*c*, 98*c* occurs near the rear end of left crown portion 78, more specifically left side panel 66, the bottom edge 124 of left sunshield member 118 should follow a path aligned with bottom crown edge 84 all the way to rear crown portion 58. Similarly, at least a front portion of the bottom end of right sunshield member 160 near its bottom edge 164 is attached to crown 52 near its bottom crown edge by coupling male snap members 172*a*, 172*b*, 172*c* to female snap member 102*a*, 102*b*, 102*c* disposed on crown 52, respectively (not shown in figures). FIG. 7 shows portions of the bottom end of rear sunshield member 200 near its bottom edge 204 attaching to crown 52 near its bottom crown edge 84, with its bottom-left corner 216 and bottom-right corner 218 touching near the rear portion of left and right side panel 62, 64 of the baseball cap, respectively. With second side 248 facing toward exterior crown surface 86, male snap members 212*a*, 212*b* disposed on left side of and 214*a*, 214*b* disposed on right side of rear sunshield member 160, are coupled to female snap members 106*a*, 106*b*, 112*a*, 112*b* disposed on crown 52, respectively. This configuration provides good coverage for the back of the neck as well as the back of the ears when rear sunshield member 200 is deployed. Other embodiments may position the bottom-left and bottom-right corner 216, 218 within rear crown portion 58, especially if covering the back of the ears is not the objective.

Figure 8:
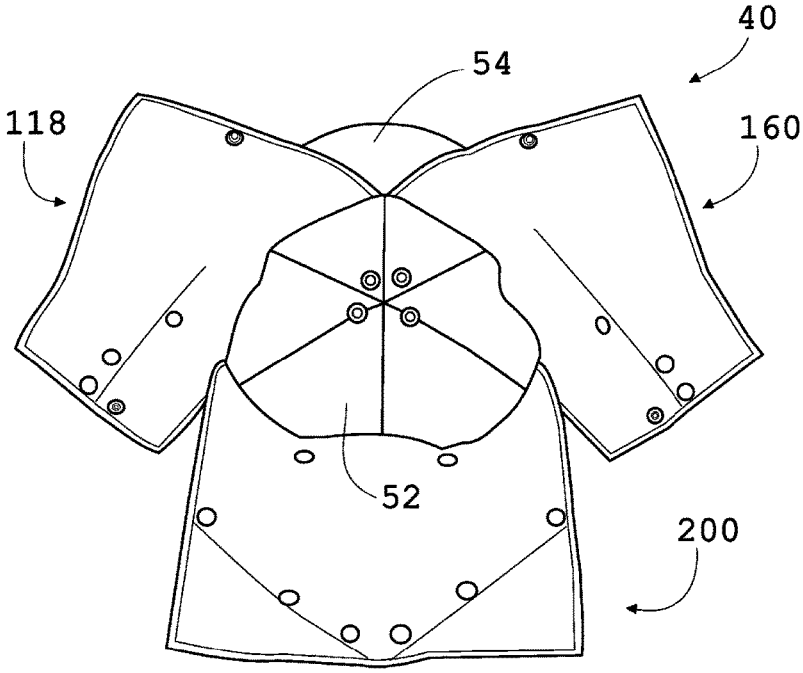
FIG. 8 is a top plan view of the cap body with all three sunshield members attached near the bottom crown edge.

To provide an idea of the overall layout of sunshade cap 40, FIG. 8 shows the top plan view of sunshade cap 40 lying on a flat surface, with the bottom end of all three sunshield members 118, 160 and 200 attached to the base of crown 52 and spread out on the flat surface. Again, it is important to note that the front end of left and right sunshield members 118, 160 are attached to crown 52 near front centerline 72, and their rear portions are not attached. FIG. 9 shows sunshade cap 40 worn with all its sunshield members 118, 160, 200 in their deployed position, providing shading to the sides of the face and back of the neck. Left and right sunshield members 118, 160, being quite sizeable, drape down starting near the front end of the sides of the visor 54, which provides ample shading of the side of the face, particularly the forwardly portion when the sun is shining from the side, with the second side 158, 198 facing outward in this deployed shading position. The rearmost attachment near the end of the left and right crown portions 78, 80 also creates an angle of draping almost parallel to the side of the face that enables the rear end of the side of the face, including the ears, to be shaded as well. Unlike a mask, there is enough space between left and right sunshield member 118, 160 and the face such that they don't come in contact with each other, thus minimizing skin irritation. The rear sunshield member 200, also being quite sizeable, drapes down and covers the back of the neck, as shown in FIG. 10, with second side 248 facing outward in this deployed shading position. Since bottom-left corner 216 and bottom-right corner 218 of rear sunshield member are attached near the rearward portion of left crown portion 78 and right crown portion 80, instead of on the rear crown portion 58, there is more shielding of the back of the ears.

Figure 12:
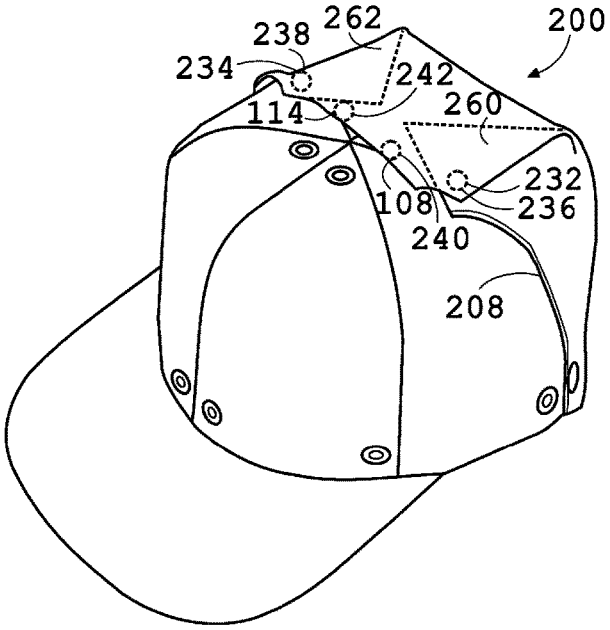
Figure 13:
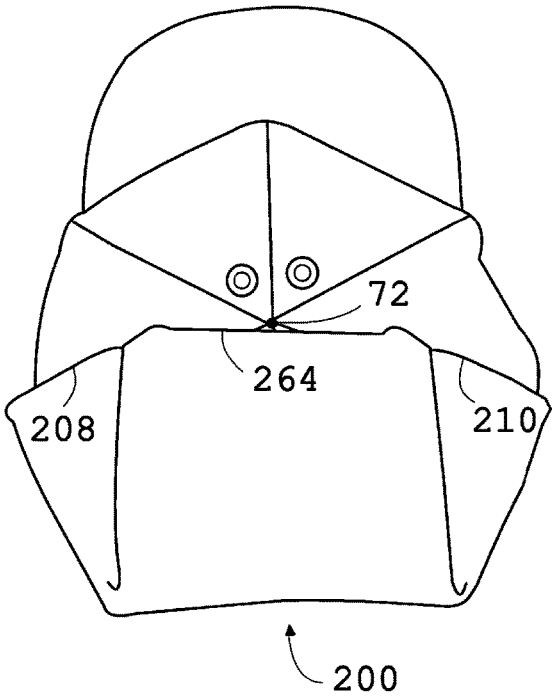
FIG. 13 is a top plan view of the cap body with attached rear sunshield member retracted.

The following description will discuss how sunshield members 118, 160, 200 are secured in their retracted position and stored away on crown 52 of sunshade cap 40. First, it is important to understand terms used to describe the folding. There are two basic types of folds, mountain fold and valley fold. A mountain fold is a convex fold in that the fold edge along the fold line is higher than the outer edges, like a mountain, and a valley fold, made in the opposite direction, is a concave fold in that the folded edge along the fold line is lower than the outer edges. Retracting rear sunshield member 200 to its stored position atop crown 52 requires several steps that involve folding top-left and top-right corners 220, 222 inward, and pinching fabric to form angled folded flaps. Now referring to FIG. 11, with the bottom end near bottom edge 204 already attached to crown 52 near its bottom crown edge 84, the first step is to make mountain folds along fold lines 224 and 226, shown in FIG. 5A, resulting in the creation of top-left folded edge 250 and top-right folded edge 252. The second step is making valley folds along left-side first fold line 228, and right-side first fold line 230, and securing those folds by coupling male snap member 236 to female snap member 232 on the left side, and male snap member 238 to female snap member 234 on the right side. The third step is to make mountain folds along vertical left-side and right-side second fold lines 256 and 258 to form inward extending folded flaps. The fold flaps created will be angled, starting from the focal point shared by the two fold lines and extending to the edge, and the angle of the rise will be defined by the angle between first fold lines 228, 230 and second fold lines 256, 258, respectively. The fourth step is to use the second fold lines 256, 258 as an axis to guide left rear folded flap 260 and right rear folded flap 262 so that they are tucked underneath each respective fold line and toward the middle of rear sunshield member 200, as shown in FIG. 12, thus securing the folded flaps in place. The final step is to make a mountain fold along top fold line 254, and to couple male snap members 240 and 242 to female snap members 108 and 114 that are disposed near vertex 72 of crown, respectively, thereby securing the top portion of rear sunshield member 200 to top of crown 52 near vertex 72, to thereby complete the retraction. As FIG. 13 shows from a top plan view, the edges remaining after folding are mainly the lower portion of the left and right edges 208, 210, and top folded edge 264. This not only greatly reduces the overall edge lengths for fitting atop crown 52, but also transforms the large flat rear sunshield member 200 with two awkward corners 220, 222 into a much smaller three-dimensional curved convex shape that complements the curved shape of the crown 52. From the top view, the retracted rear sunshield member 200 is stored on crown 52, with top folded edge 264 disposed just below vertex 72, in a neat and organized manner with minimal crumpling of fabric.

Figure 14:
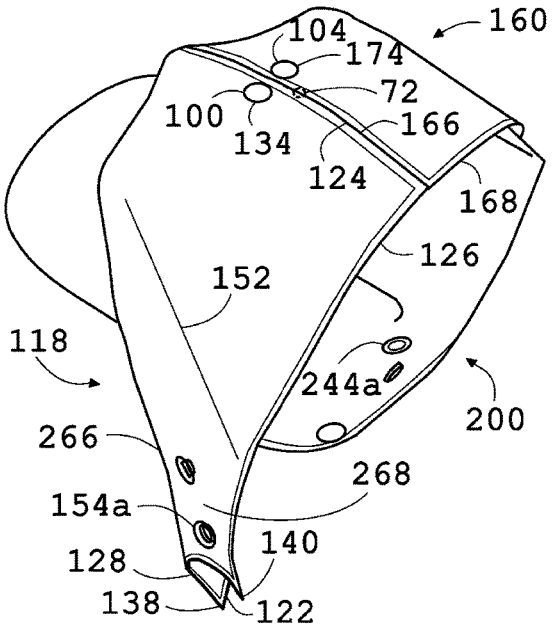
FIG. 14 is a rear perspective view of the sunshade cap, with an extending angled folded flap formed from the left sunshield member ready to be retracted.

Now referring to FIG. 14, retracting the left and right sunshield members 118, 160 to its stored position requires several steps, which also involve the pinching fabric to form a large angled folded flap 268, 270 that emerges from the central region and becomes more prominent toward the edges. With the forward portion of the bottom end of left and right sunshield member 118, 160 already attached to crown 52 near bottom crown edge 84, and with rear sunshield member 200 already retracted, the first step is to line up and lay down front edge 124, 166 so that it abuts front centerline 74, and to couple male snap member 134, 174 with female snap member 100, 104, respectively. Front edge 124, 166 continues unattached past vertex 72 for approximately 7.6 cm (3 inches) and flows along rear centerline 82, and top edges 126, 168 line up with each other. Since FIG. 14 and FIG. 15 primarily show left sunshield member 118, the next few steps will discuss retraction of that particular sunshield member, which can then be similarly applied to right sunshield member 160. The second step is to create a left side folded flap 268 by making a mountain fold along first fold line 150, shown in FIG. 3A, to produce a folded flap edge 266. The third step is to make a valley fold along second fold line 152, which forms an axis of rotation allowing left side folded flap 268 to swing to the right until it lies horizontally and flush with crown 52. An angled folded flap 268 emerges from the central region where the two fold lines share a focal point and gradually rises as it nears the edge, with the angle of the rise defined by the angle between the two fold lines. When left side folded flap 268 is formed using the above-described folds, left sunshield member 118 no longer has a flat shape, but becomes a concave shape that allows it to somewhat hug the curved crown 52, thus avoiding the crumpling and wrinkling that often occurs when one tries to wrap a flat fabric about a curved object. The surface area of left sunshield member 118 is reduced by basically transforming four edges into three edges and a flap. The final step is coupling male snap member 154*a* disposed on left side folded flap to female snap member 244*a* disposed on rear sunshield member 200. The position of female and male snap members 154*a*, 244*a*, and bringing them together for coupling, serves to guide the movement of left side folded flap 268 to its retracted position. When this is done, both left sunshield member 118 and left side folded flap 268 are considered retracted in its stored position. The folded flap can be easily unfolded if left sunshield member 118 needs to be deployed simply by uncoupling a few snap members.

Figure 15:
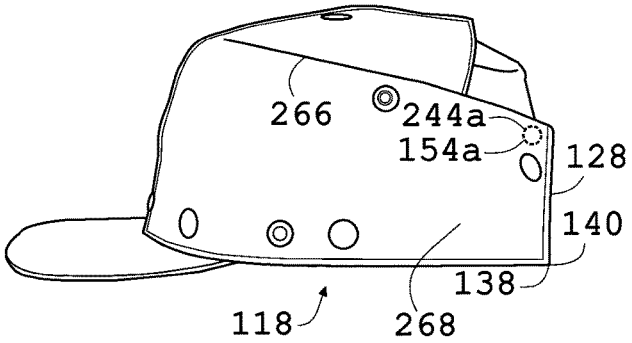
FIG. 15 is a side elevational view of the sunshade cap, with an angled folded flap of the left sunshield secured in its retracted position to the retracted rear sunshield member.
Figure 16:
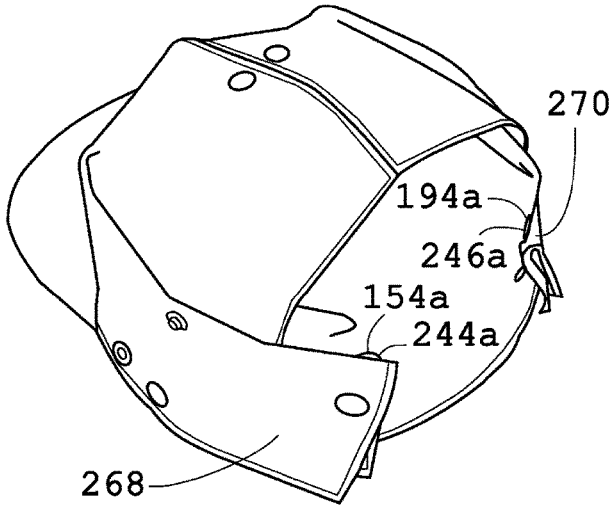
FIG. 16 is a rear perspective view of the sunshade cap, with both the left and right sunshield members fully retracted.
Figure 17:
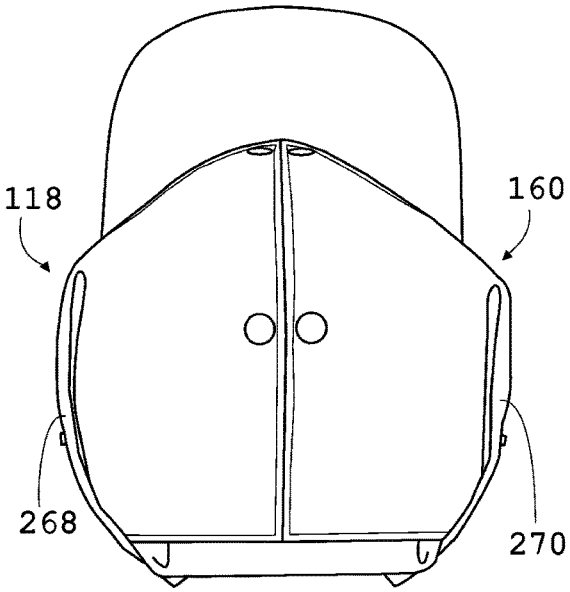
FIG. 17 is a top plan view of the sunshade cap with all three sunshield members retracted.
Figure 18A:
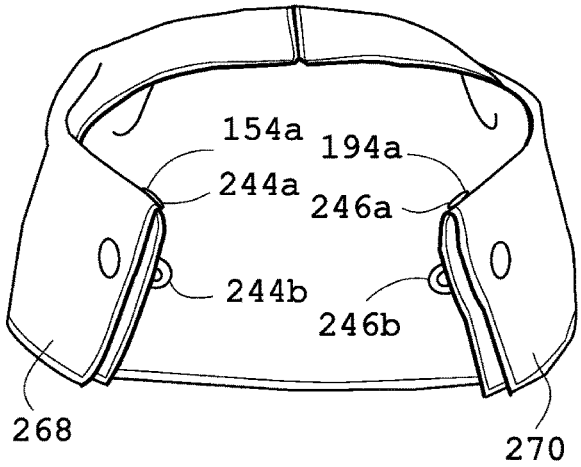
FIG. 18A and FIG. 18B are rear elevational views of the sunshade cap, with angled folded flaps of the left and right sunshield members attached with plastic snap fastening members to the rear sunshield member at various positions.
Figure 18B:
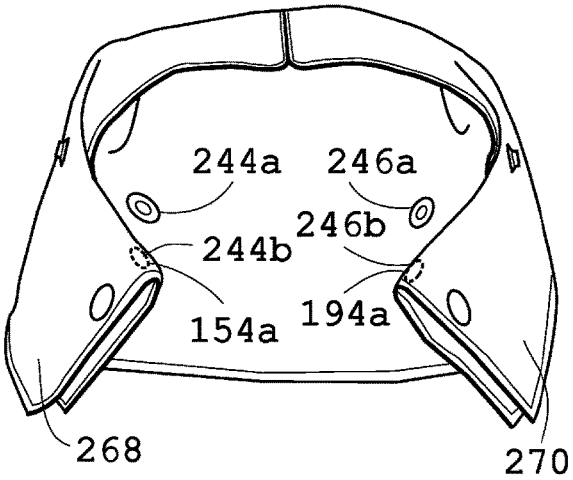

FIG. 15 shows a left side elevational view of left sunshield member 118 in its retracted position, where one can see that folded flap edge 266 now becomes the top edge, rear edge 128 virtually disappears as a main edge and is now folded in half to form an upside-down v-shaped edge at the rear end of left side folded flap 168, the rear portion of top edge 126 is now aligned with and behind bottom edge 122, and rear-bottom corner 138 is aligned and in front of rear-top corner 140. Retracting right side folded flap 270 is performed in a similar manner, as shown in FIG. 16, with male snap member 194*a* coupling with female snap member 246*a* to secure right side folded flap 270 to rear sunshield member 200. FIG. 17 shows a top plan view of sunshade cap 40 with left, right and rear sunshield members 118, 160, 200 retracted in a neat and orderly fashion, something one would not expect from folding three large sunshields and placing them on top of the crown. FIG. 18A shows the rear elevational view of the fully retracted sunshade cap 40, with male snap members 154*a*, 194*a* attached to female snap members 244*a*, 246*a* respectively. In the exemplary embodiment, there is another alternative positioning of the left side and right side folded flap 268, 270 lower down on rear sunshield member 200 by attaching male snap members 154*a*, 194*a* to female snap members 244*b*, 246*b*, respectively, as shown in FIG. 18B. This offers a different look to the back as well as slightly more shading to the sides of the back and the top of the ear, although this retraction of left and right side folded flaps 268, 270 is not the main purpose of female snap members 244*b*, 246*b*, which will be explained later.

Figure 19:
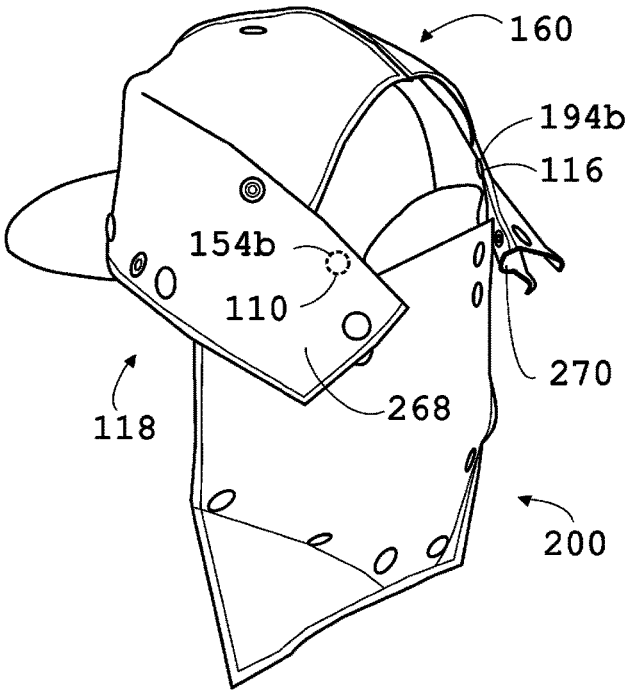
FIG. 19 is a rear perspective view of the sunshade cap, with the left and right sunshield members retracted while the rear sunshield member is deployed.
Figure 20:
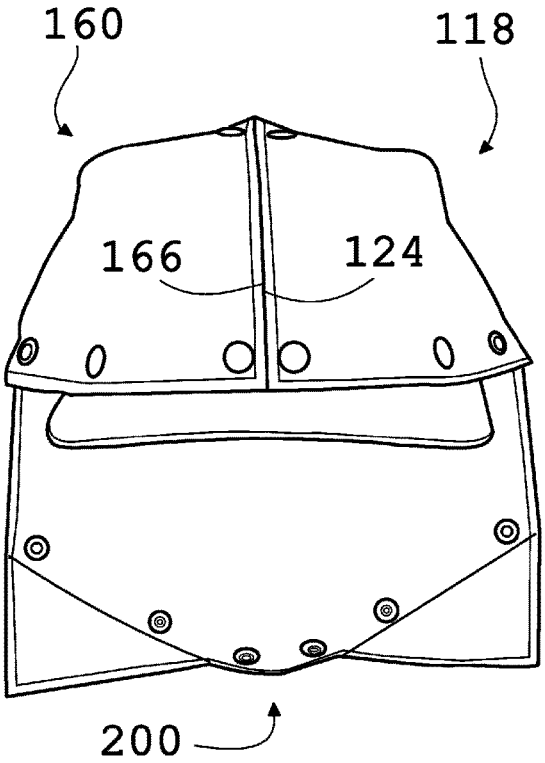
FIG. 20 is a front elevational view of the sunshade cap, with the left and right sunshield members retracted while the rear sunshield member is deployed.

One of the important features of sunshade cap 40 is that each sunshield member may be independently deployed and retracted no matter whether other two sunshield members are deployed or retracted. FIG. 19 shows rear sunshield member 200 being deployed while left and right sunshield members 160, 200 are retracted. This is made possible by coupling male snap fasteners 154*b*, 194*b* to female snap members 110, 116, respectively, that are disposed on crown 52. Male snap members 154*b*, 194*b* are specifically added to sunshield members 118, 160 because male snap fasteners 154*a*, 194*a* are not in a good position to couple with female snap members 110, 116 in a manner that would secure left and right side folded flaps 268, 270 neatly and tightly to crown 52. FIG. 20 shows the front view of the same configuration, which provides sunshading to the back of the neck and back of the ears when the sun is shining from the rear. One can see from this figure that the front edges 124, 166 of the left and right sunshield members abut along front centerline 74 during retraction, so that there is a neat appearance at the front of sunshade cap 40. If one wanted to then deploy the left sunshield member 118 for full shading, one would uncouple the male snap member 134 from female snap member 100 near the vertex 72, shown previously in FIG. 14, and uncouple male snap member 154*b* from female snap member 110, shown in FIG. 19. There are many different combinations of deployments possible with this invention, and even more when considering the additional ability of sunshade cap 40 to independently shade the ears, which will be discussed next.

Figure 21:
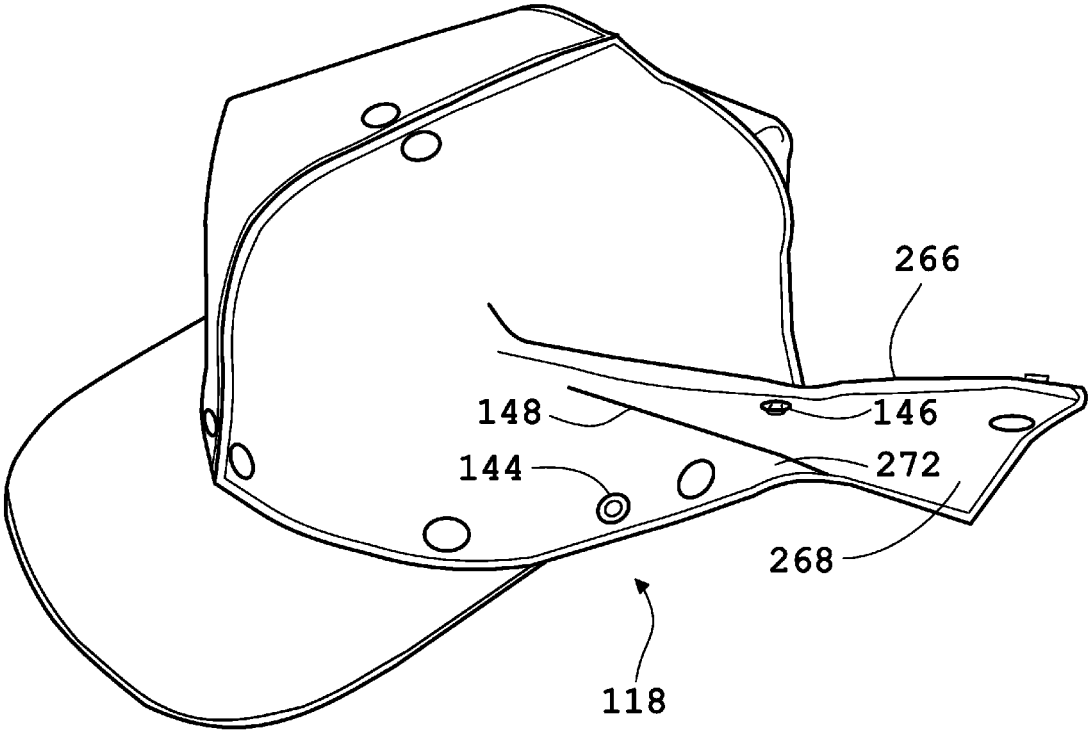
FIG. 21 is a front perspective of the sunshade cap, with the angled folded flap of the left sunshield member in an extended position as it is ready to be deployed as an earflap.
Figure 22:
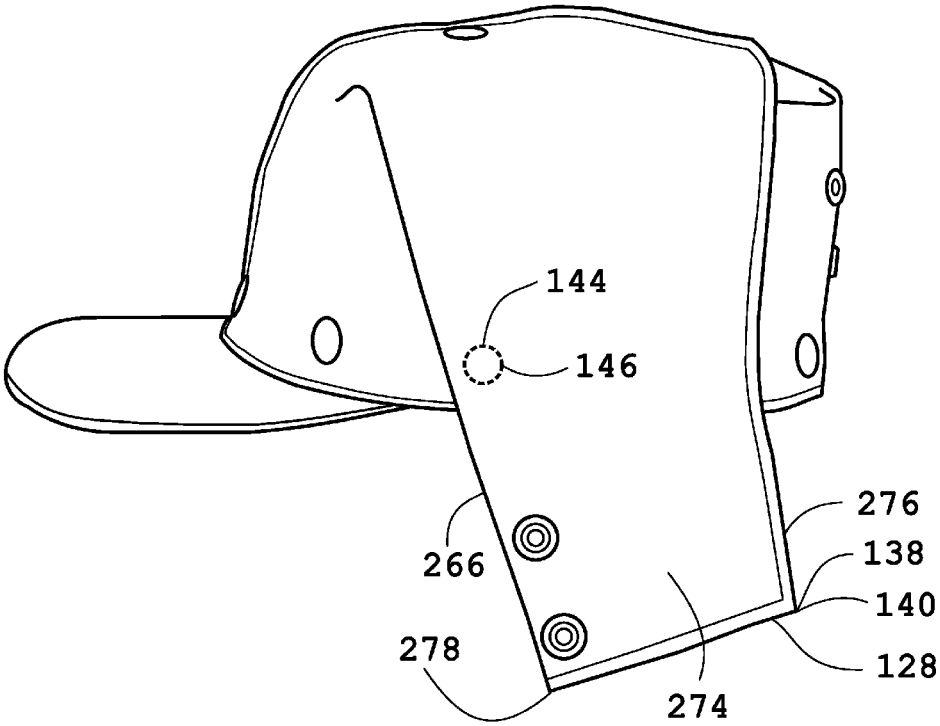
FIG. 22 is a side elevational view of the sunshade cap with an earflap deployed.

A unique feature provided by this exemplary embodiment is the ability to deploy an earflap 274 to cover each ear using the same left and right sunshield member 118, 160 that covers the side of the face, in effect giving each sunshield member different roles. FIG. 21 and FIG. 22 show how earflap 274 is deployed for shading. An earflap 274 is actually one and the same as left side folded flap 268, with the only main distinction being that the former is the latter turned downward to cover the ears. That is not to say that left side folded flap 268 will necessarily be an earflap 274. For instance, if the bottom edge 122 and top edge 168 of the left sunshield member 118 are not long enough, the folded flap may be too short and therefore cannot be deployed as an earflap 274. As explained later, alternative embodiments of this invention may exclude earflaps altogether, since that might not be desired by some wearers, and with the folded flap being used for retraction purposes only, no detachable fastening members will be configured on the sunshield member to secure an earflap into position. In the exemplary embodiment, however, the earflap 274 is an important feature. The first step is to make a mountain fold along first fold line 150, shown in FIG. 3A, to create folded flap edge 266. If left sunshield member 118 is already stored in a retracted position, this folding step has already occurred, but any attached snap member on left side folded flap 268 must be uncoupled. FIG. 21 shows left side folded flap 268 in a neutral position, where it projects outward and diagonally, ready to form earflap 274. The second step is to make a valley fold along diagonally-positioned third fold line 148, shown in FIG. 3A, whose angle 272 to the bottom edge is preferably approximately 45 degrees, which enables earflap 274 to be deployed vertically and to be retracted horizontally. This fold then acts like an axis that guides left side folded flap 268 to swing along a downward path until it drapes down below crown 52 and becomes an earflap 274, as shown in FIG. 22. The final step is to couple male snap member 146 to female snap member 144, both located on left sunshield member 118, to secure earflap 274 in its deployed position. In this position, the folded flap edge 266 faces forward, the v-shaped folded rear edge 128 faces down, the rear portion 276 of top edge 126 faces towards the rear, and rear-top corner 140 is aligned on top of rear-bottom corner 138. For practical reasons, it is preferable that bottom-forward corner 278 of earflap 274 be a 90 degree right angle, as this allows rear edge 128 of left sunshield member 118 to be a straight edge, which makes it much easier during the manufacturing process of cutting and hemming. The width of earflap 274 is determined by the length of rear edge 128, which is the latter folded in half, so that the longer the rear edge 128, the wider the earflap 274. As one can see, earflap 274 is relatively easy to deploy and provides ample shading for the ears. If earflap 274 is no longer needed, the wearer can easily retract it by swinging it into a horizontal retracted position, as previously described, or fully deploy left sunshield member 118. The right earflap 274 (not shown is the drawings) is deployed in the same manner as the left earflap 274, secured in its draped down position by coupling male snap member 186 to female snap member 184.

Figure 23:
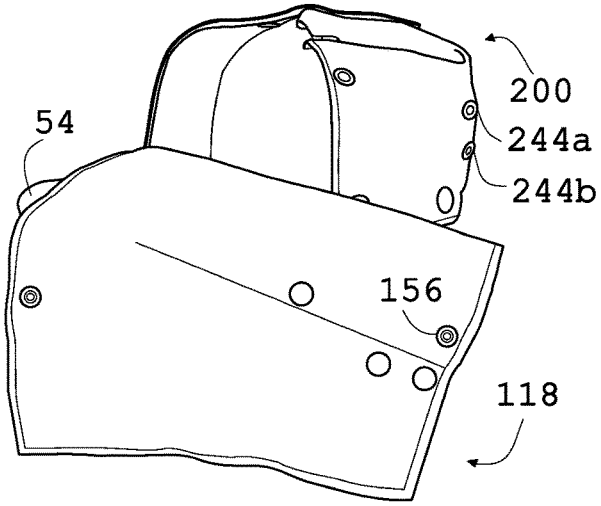
FIG. 23 is a side elevational view of the sunshade cap, with left sunshield member deployed in its regular full coverage position, and with the rear sunshield member retracted.
Figure 24:
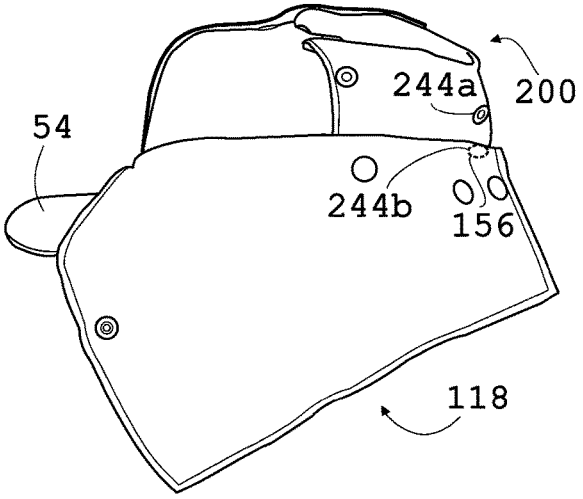
FIG. 24 is a side elevational view of the sunshade cap, with the left sunshield member deployed in the wider viewing mode, and with the rear sunshield member retracted.
Figure 25:
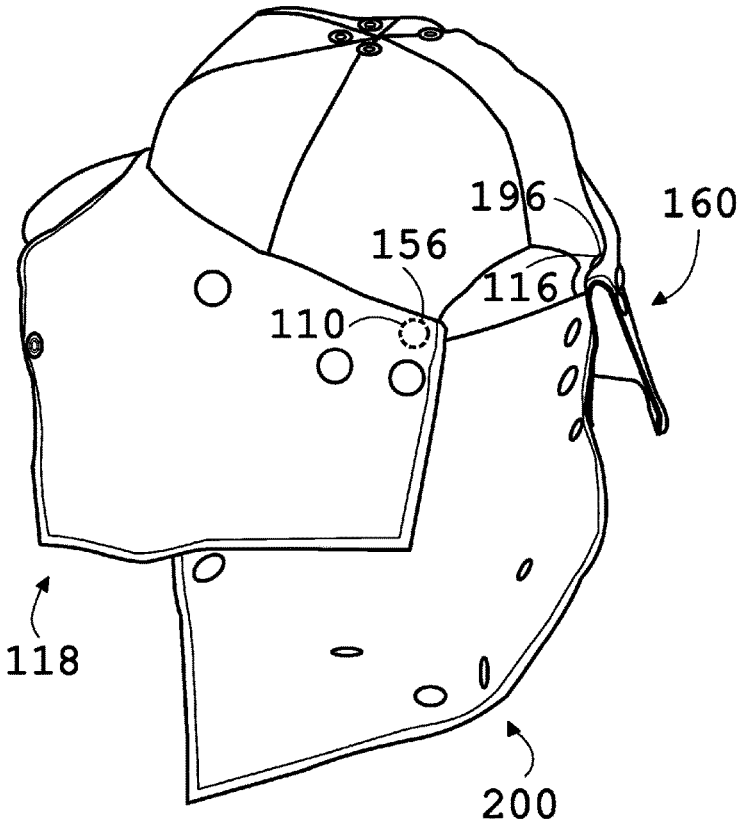
FIG. 25 is a rear perspective view of the sunshade cap, with the left and right sunshield members deployed in the wider viewing mode while the rear sunshield member is deployed.

Another unique feature of sunshade cap 40 is the ability of left and right sunshield members 118, 160 to be deployed in both a regular mode and a wider viewing mode that offers a wider field or angle of vision for the wearer. While the regular mode offers great shading for the side of the face, especially the forward portion of the face, sometimes the wearer is willing to forgo some sunshading for better peripheral vision, especially for certain activities like watching sporting events or moving around. For left sunshield member 118, this is made possible with male snap member 156, as shown in FIG. 23. To provide the wider field of view while rear sunshield member 160 is retracted, as shown in FIG. 24, male snap member 156 is coupled with female snap member 244*b*, which was specifically configured for this purpose because female snap member 244*a* is so high that it is hard to reach and coupling there would cause the rear of the side of the face to get much less shading than desired. To set right sunshield member 160 for wider angle viewing, male snap member 196 is coupled with female snap member 246*b* located on rear sunshield member 160, which is not shown. It is also possible to deploy left sunshield member 118 to a wider viewing mode while rear sunshield member 160 is also deployed, as shown in FIG. 25. All that is required is to couple male snap member 156 to female snap member 110 located on rear crown portion 58. For the right sunshield member 160, male snap member 196 is coupled with female snap member 116, as also shown in FIG. 25.

Figure 26A:
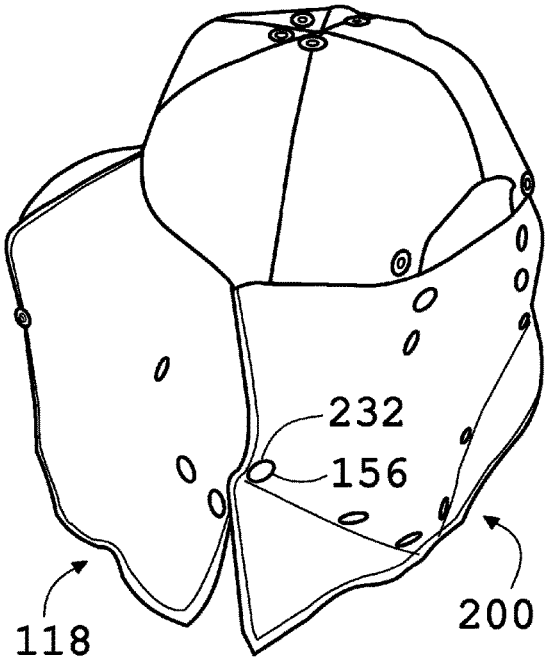
FIG. 26A is a rear perspective view of the left and rear sunshield member deployed and attaching using an existing snap fastening member.
Figure 26B:
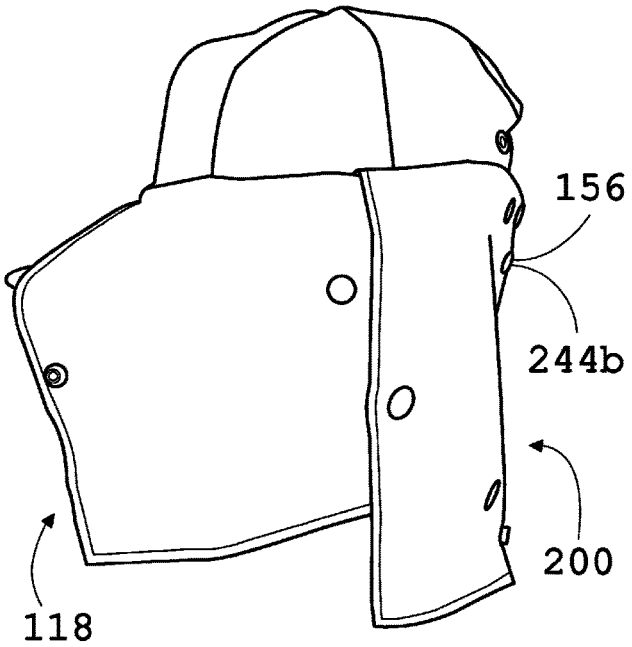
FIG. 26B is a side elevational view of the deployed sunshield members attaching using a different existing snap fastening member.
Figure 27:
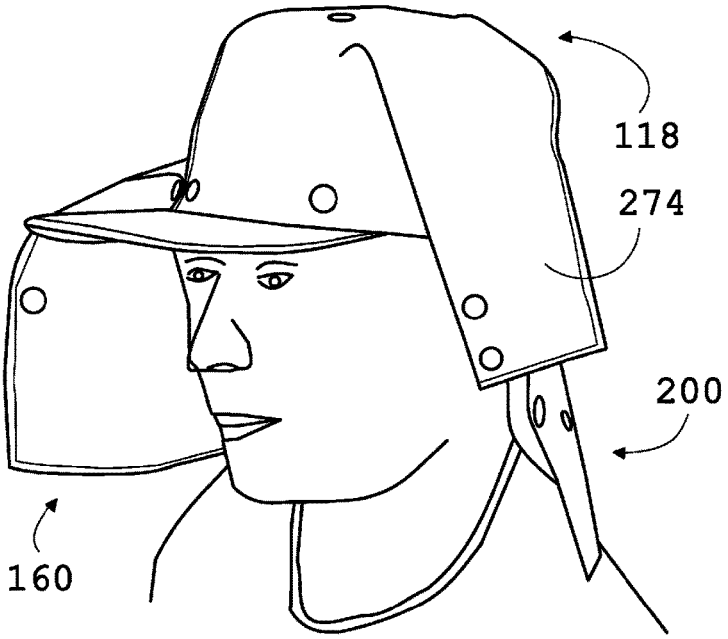
FIG. 27 is a front perspective view of a sunshade cap worn, with deployed right sunshield member, left earflap, and rear sunshield member to show independent targeted shading.

While sunshield members 118, 160, 200 can act independently, they can also be interconnected when deployed, which is sometimes desireable when the wearer wants to close any gaps in sunshading coverage, or when interlocking the sunshield members would provide more stability from flapping around, especially when it gets windy. Several existing snap members are already available to provide this function, although new additional fasteners may be added as well. FIG. 26A and FIG. 26B shows that male snap member 156, which faces the second side 158 of left sunshield member 118, is able to connect to female snap member 232 and to female snap member 244*b*. So even though each sunshield member can independently provide shading coverage, there is a lot of interaction between them, unlike prior art where one often sees no interaction between earflaps or side sunshield members, and rear sunshield member. For right sunshield member 160, male snap member 196 can either be coupled with female snap member 234 or to female snap member 246*b*, not shown here. The ability of the sunshade cap 40 to provide independent target sunshade coverage must again be emphasized. FIG. 27 shows an example of the wearer taking advantage of the ability of sunshade cap 40 to provide a variety of deployment positions, here deploying right sunshield member 160 in its regular mode, deploying rear sunshield member 200, and deploying left earflap 274. If one adds up all the options, such as the coverage areas of the sides of the face, ears and back of neck, the regular and wider viewing mode, and interlocking of sunshield members, it is apparent that sunshade cap 40 offers the wearer many choices.

However, the choices do not end there. One of the important features of the sunshade cap 40 is that the sunshield members 118, 160, 200 are detachable. One advantage of this is that the sunshield members can be detached and carefully washed by hand. By far the most important advantage, though, is related to the fact that the sunshield members are large and can cover the entire crown 52 when retracted. This enables the sunshade cap 40 to change the entire crown 52 into a different color simply by swapping sunshield members of one color with those of another color, and the choices of colors are limitless. The wearer could also attach sunshield members of different colors that drape down and become very visible to others far away, thus allowing sports fans to root for a favorite team by using sunshield members with team or school colors or even national flag colors, and deploying them at opportune times during the game other than for shading. Similarly, different logos and other indicia, including advertising, can be placed on the sunshield members, and deployed to catch the attention of others. The crown 52 could have colors that coordinate with the sunshield members, or have a neutral color such as black that does not draw attention away from the colors of the sunshield members.

Figure 28:
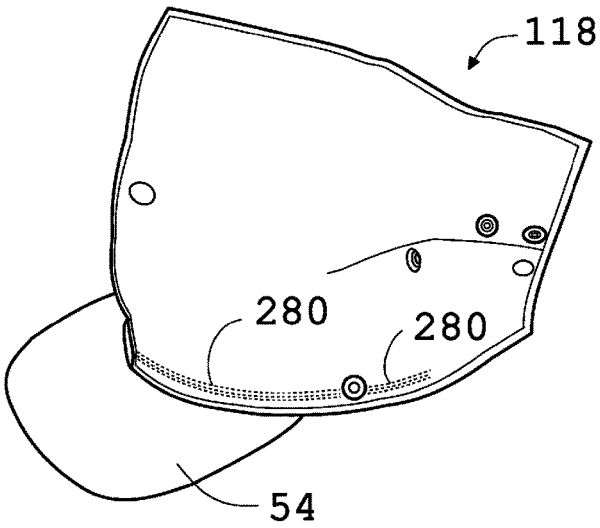
FIG. 28 is a front left perspective view of an alternative embodiment, with the left sunshield member held upright as its bottom end is attached to the crown with stitches.
Figure 29:
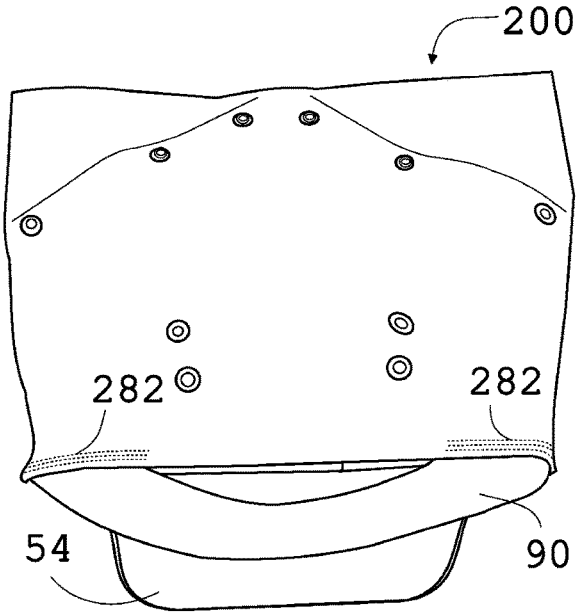
FIG. 29 is a rear perspective view of an alternative embodiment, with the rear sunshield member held upright as its bottom end is attached to the crown with stitches.

An alternative exemplary embodiment, though part of the same genus, is to use the same left, right and rear sunshield members 118, 160, 200 and also to use fastening members in the same manner as the exemplary embodiment, but instead of using detachable fastening members to attach the bottom end of those sunshield members to the crown 52 that allow detachability, permanent fastening members are instead used to permanently attach them. For permanently attaching the sunshield members to the crown, stitching is the easiest and most economical one to use, as it eliminates approximately 10 male-female pairs of snap members. However, other permanent fastening members may be used too, including but not limited to, glues and adhesives, staples, grommets, and rivets, or a mix of any permanent fastening members. FIG. 28 shows stitches 280 replacing certain snap fasteners in the exemplary embodiment on left sunshield member 118, namely those shown in FIG. 6, which are male snap members 132*a*, 132*b*, 132*c*, and also female snap members 98*a*, 98*b*, 98*c* disposed on crown 52. For right sunshield member 160, stitches 280 would replace male snap members 172*a*, 172*b*, 172*c*, and also female snap members 102*a*, 102*b*, 102*c* disposed on crown 52, not shown in drawings. FIG. 29 shows stitches 282 replacing certain snap fasteners that are disposed on rear sunshield member 200 in the exemplary embodiment, namely those shown in FIG. 7, which are male snap members 212*a*, 212*b*, 214*a*, 214*b* and female snap members 106*a*, 106*b*, 112*a*, 112*b* disposed on crown 52. All other fastening members disposed on the alternative exemplary embodiment should be detachable fastening members, similar to the exemplary embodiment. Although plastic snap fasteners are the preferred fasteners, other detachable fasteners that may be used, include, but not limited to, metal snaps, magnetic fasteners, magnetic snaps, hook and loop, hoop and eye, buttons, latches and zippers, or a mix of any detachable fasteners. Since there is no risk of the sunshield members being accidentally pulled off the crown, the alternative exemplary embodiment can be used for more rugged environments, such for farming, camping and hiking, fishing and military activities.

Figure 30:
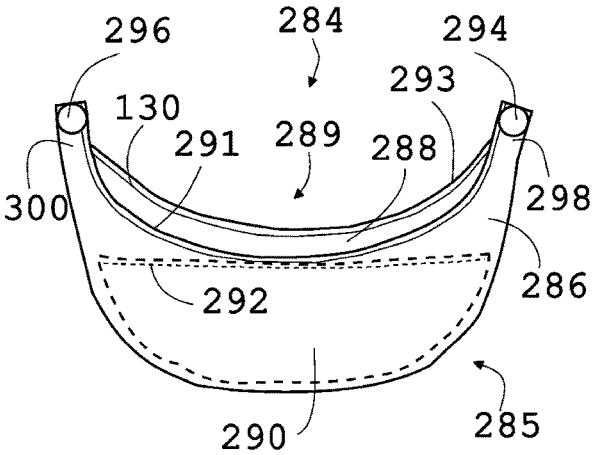
FIG. 30 is a front perspective view of the front sunshield member of additional embodiment.

An additional exemplary embodiment, which is also part of the same genus because it includes all of the elements of the exemplary embodiment, adds an additional fourth sunshield member to cover the front of the face below the eyes, and shall be referred to as the four sunshield shading cap 312, shown being worn in FIG. 32. This fourth sunshield member, herein referred to as front sunshield member 284 as shown in FIG. 30, is basically a visor sleeve 285 that fits over visor 54, where it can be retracted when not deployed. Front sunshield member 284 generally includes a visor sleeve 285 having a front portion 286 and a rear portion 288, a sleeve opening 289, a sleeve flap member 290, a left end 298 and a right end 300 of front portion, a left end 302 and a right end 304 of rear portion, and a plurality of snap fasteners, which will be referred to in detail below. Front sunshield member 284 is made using similar fabric or fabric-like material as the other sunshield members. Front portion 286 and rear portion 288 should generally match the shape of the visor, but with left end 298 and right end 300 of front portion near sleeve opening 289 being slightly longer than left end 302 and right end 304 of rear portion to extending out, and having square corners instead of acute ones so that female snap members 294, 296 facing the rear can be place there. Front portion 286 is sewn to the rear portion 288 such that a person skilled in the arts would be able to produce a visor sleeve seam 310, shown in FIG. 35, along the entire edges of contact between the two portions. Bias tape binding 130 is used to hem front sleeve opening edge 291 and rear sleeve opening edge 293 located at sleeve opening 289 of visor sleeve 285. In order to prevent rear portion 288 from drooping when front sunshield member 284 is fitted over visor 54, it may be reinforced with stiffening material such as buckram backing 94, which may be curved to match the contour of visor 54.

Figure 31:
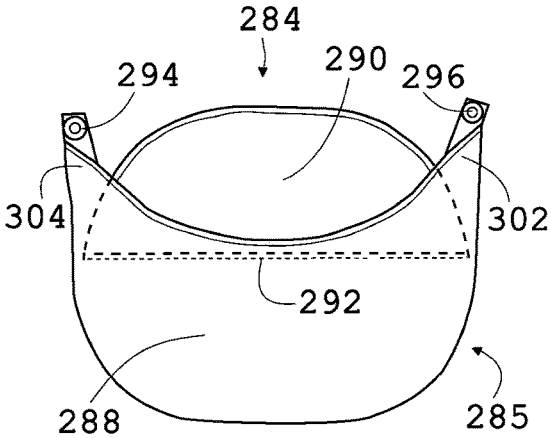
FIG. 31 is a rear elevational view of the front sunshield member of additional embodiment, with sleeve flap member extending outward.

On the interior side of front portion 286, a sleeve flap member 290, made out of the same fabric-like material as front portion 286 and rear portion 288, and shaped like visor 54 except that the top edge is straight from one end to the other instead of curved and its size is small enough to fit inside front sunshield member 284, is attached with stitches 292 laterally from left to right across front portion 286 near the opening of front sunshield member 284. In FIG. 31, which shows a rear elevational view of front sunshield member 284 with sleeve flap member 290 deployed, the edge of sleeve flap member 290 that is not secured to front portion 286 with stitches 292 is turned up so that it extends outward beyond front sleeve opening edge 291, where it is then held in place by being sandwiched between front portion 286 and rear portion 288 at both ends. Sleeve flap member 290 may be sewn onto front portion 286 either while resting in a stored position or resting in a deployed position, with the difference being that the former requires folding flap sleeve 290 along the stitch to deploy, while the latter requires folding flap sleeve 290 down along the stitch to retract. Besides stitches, sleeve flap member may also be attached to front portion 286 using either detachable fastening members or permanent fastening members. Sleeve flap member 290 should preferably be somewhat thicker than the other portions of front sunshield member 284 to help it stand upright without going limp. Alternatively, sleeve flap member 290 may be partially made of stiffer flexible material such as polypropylene, or it may use cloth fabric backed on one side in certain areas with stiffening material such as buckram, preferably the side not visible when deployed.

Figure 32:
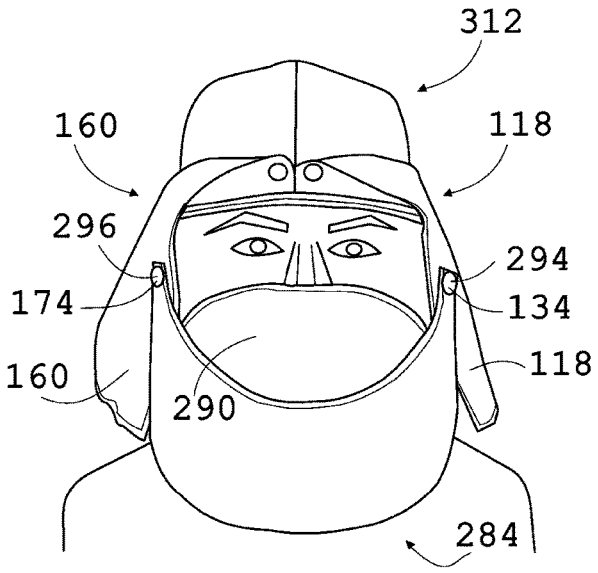
FIG. 32 is a front elevational view of the additional embodiment being worn, with the front sunshield member attached to the left and right sunshield members with plastic snap fasteners.
Figure 33:
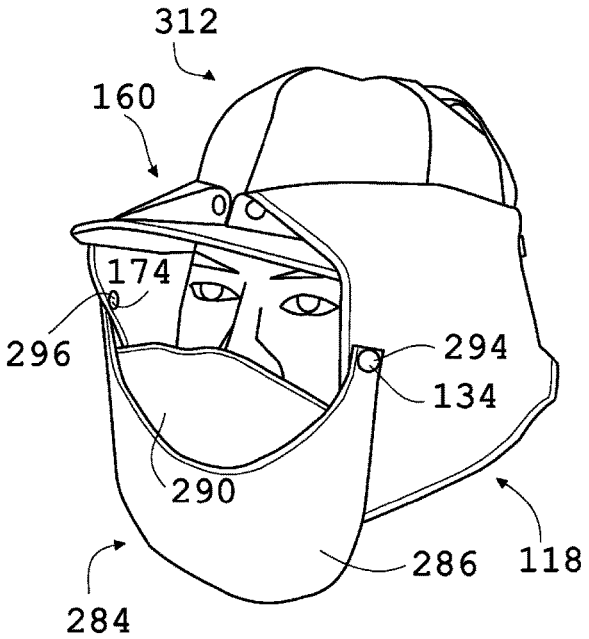
FIG. 33 is a front perspective view of the front sunshield member of the additional exemplary embodiment being worn, with the front sunshield member attached to the left and right sunshield members when both are deployed in the wider viewing mode.

To deploy front sunshield member 284 on four sunshield sunshade cap 312, as shown in FIG. 32, female snap member 294 is coupled to existing male snap member 134 located on left sunshield member 118, and female snap member 296 is coupled to existing male snap member 174 located on right sunshield member 160. Since front sunshield member 284 is attached to left sunshield member 118 and right sunshield member 160 while latter is deployed in their regular mode of draping, this mean that front sunshield member 284 will drape at a good distance from the front of the face. While this provides good shading to the lower portion of face when the sun is shining directly in front of the face, if the sun is shining down upon the face at an angle, it may be preferable to have front sunshield member 284 drape down closer to the face to prevent the sunrays from shining on the nose and cheeks, unless visor 54 is very long. This can be done by attaching front sunshade member 284 to left and right sunshield member 118, 160 while the latter are deployed in the wider viewing mode, as shown in FIG. 33. To allow adjustability of front sunshield member 284 in its shading, additional fastening members may be disposed on left and right sunshield members 118, 160, or on front sunshield member 284, in which case left and right ends 298, 300 of front portion 286 may need to be lengthened, or a straps may be used instead. Alternatively, using a different type fastener, such as loop and hook, may provide better adjustability. Another way to have front sunshield member 284 shading higher on the face is to have four sunshield sunshade cap 312 include a longer visor 54, which then would allow a longer visor sleeve 285 and sleeve flap member 290. So if a 10.2 cm (4 inch) visor is used instead of a 7.6 cm (3 inch) visor 54, this would translate into an increase of 5.1 cm (2 inches) in additional shading coverage, 2.5 cm (1 inch) additional from visor sleeve 285 to provide more coverage for the chin and front of the neck, and 2.5 cm (1 inch) additional from sleeve flap member 290 to provide more coverage for nose and cheeks. Visor sleeve 285 may be longer than visor 54 to provide more shading, and both sleeve and sleeve flap member may be custom fitted to suit the wearer. In a further alternative embodiment, sleeve flap member 290 is detachably attached to front portion 286 of front sunshield member 284, allowing it be turned around and reattached in an upside down position for deployment using detachable fastening members, so that sleeve flap member 290 shades level across the face instead of curved.

Figure 34:
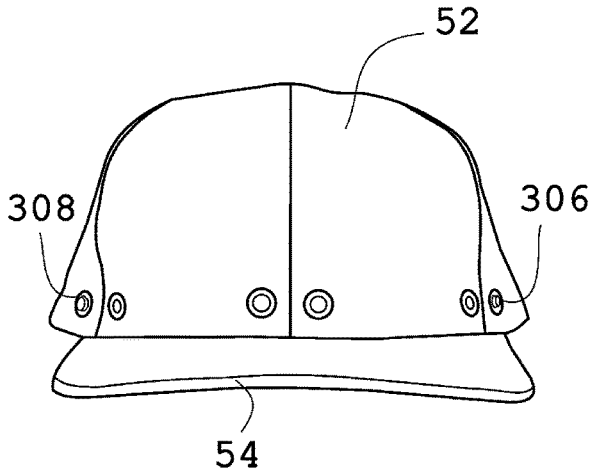
FIG. 34 is a front elevational view of the cap body of the additional exemplary embodiment showing two additional plastic snap fastening members configured on the crown.
Figure 35:
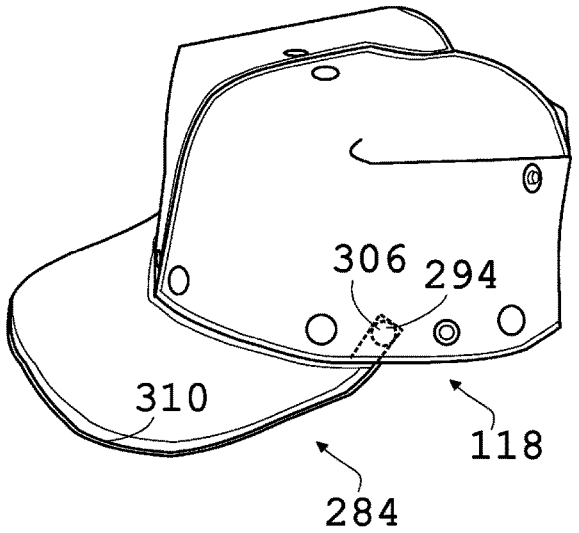
FIG. 35 is a front perspective view of the additional exemplary embodiment, with the front sunshield member retracted on the visor and secured with snap fastening members on the crown.
Figure 36:
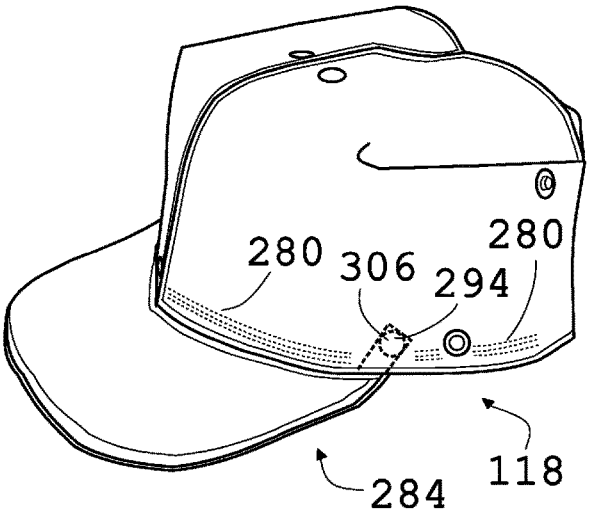
FIG. 36 is a front perspective view of a further additional exemplary embodiment, with the front sunshield member retracted on the visor and secured with snap fastening members, wherein the bottom end of the right, left and rear sunshield members are sewn onto the crown.
Figure 37:
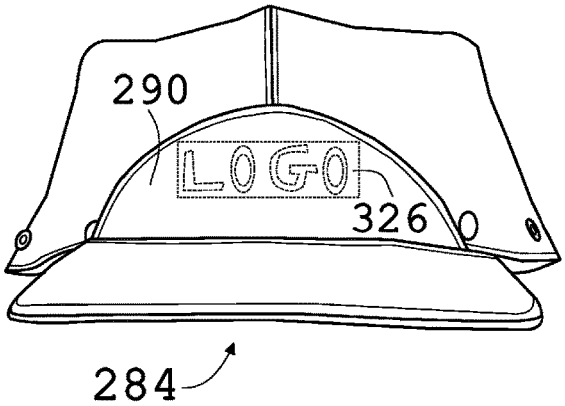
FIG. 37 is a front elevational view of the additional exemplary embodiment, with the front sunshield retracted and the sleeve flap member extended to display indicia.

In order to secure front sunshield member 284 in its retracted position over visor 54, two additional fasteners, shown in FIG. 34, are added to crown 52, male snap member 306 for the left side and male snap member 308 for right side, both disposed adjacent to bottom crown edge 84 just above the left and right end of visor 54. To retract four sunshield sunshade cap 312, sleeve flap member 290 is retracted back into visor sleeve 285, front sunshield member 284 is slipped over visor 54 through sleeve opening 289, and secured at the left end 298 by coupling female snap member 294 to male snap member 306, as shown in FIG. 35, and secured at the right end 300 by coupling female snap member 296 to male snap member 308, which is not shown. Bottom edges 122, 164 of left and right sunshield members 118, 160 are lifted up slightly so that the left and right ends of front portion 298, 300 can be slipped underneath to make the connections. In an alternative embodiment where stitches 280 replace the detachable snap fasteners, as shown in FIG. 36, a space is created between stitches 280 to allow male snap member 306 to be disposed on crown 52, and also to provide room so that female snap member 294 can slip underneath into position to secure the coupling, and similarly, for male snap member 308 to couple with female snap member 296 on the right side. FIG. 37 shows that front sunshade member 284 can also be retracted with sleeve flap member 290 extended outward and lying up against the retracted left and right sunshield member 118, 160, so that indicia 326 printed or embroidered on sleeve flap member 290 can be displayed, which offers an interesting way of using front sunshield member 284.

Figure 38:
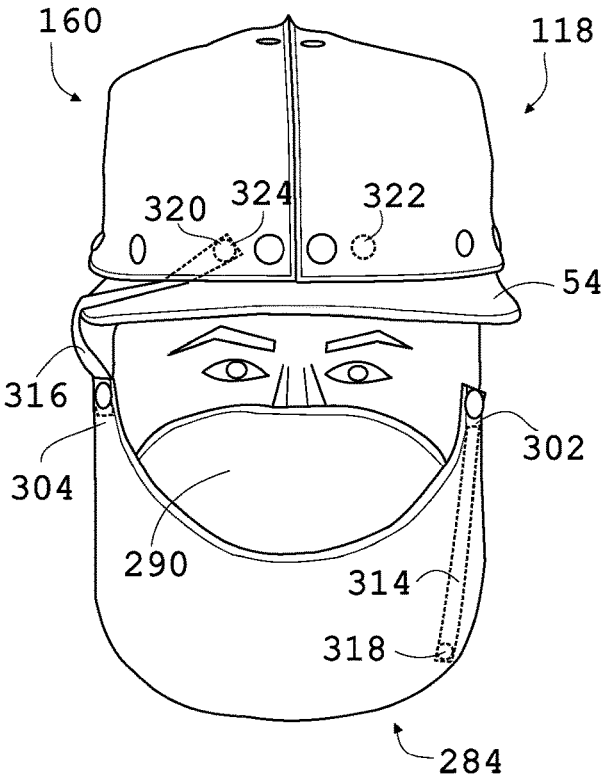
FIG. 38 is a front perspective view of another additional exemplary embodiment, with the front sunshield member including straps that attach to the front crown and that can be retracted by tucking into the visor sleeve, for independent target shading.

An additional exemplary embodiment of four sunshield sunshade cap 312 enables front sunshield member 284 to be deployed independently, without requiring the deployment of left and right sunshield members 118, 160, by further including left and right straps 318, 316 made substantially of flexible fabric or fabric-like material, and additional fastening members disposed thereon, as well as on front crown portion 56. As shown in FIG. 38, top end of left strap 314 is attached to left end 302 of rear portion 288 of visor sleeve 285, and top end of right strap 316 is attached to right end 304, using stitches 292, or other fastening members, and male snap members 318, 320 are disposed near bottom ends of left and right straps 314, 316 respectively. Further included female snap members 322, 320 are disposed near bottom crown edge 84, preferrably near front centerline 74. To deploy front sunshield member 284 independently, male snap member 320 is coupled with female snap member 324, and male snap member 318 is coupled with female snap member 322, and both left and right straps 314, 316 are positioned to drap down from each side of visor 54 so that front sunshield member 284 is suspended in front of the wearer's face. When independent shading is not required, left and right straps 314, 316 can be tucked and stored inside visor sleeve 285, as can be seen with left strap 314 in the figure.

Figure 39:
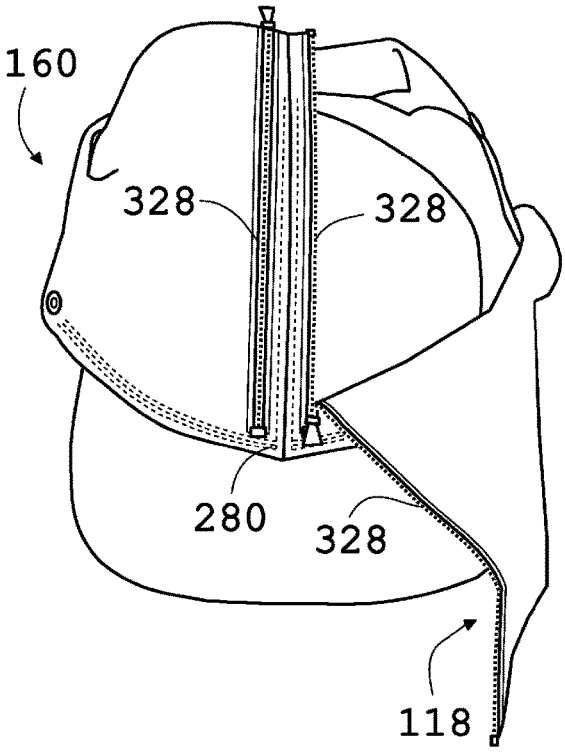
FIG. 39 is a front perspective view of an alternative embodiment using zippers.

FIG. 39 shows how an alternative exemplary embodiment wherein a zipper 328 is used on sunshade cap 40 that allow independent deployment of left and right sunshield members 118, 160. This embodiment is basically similar to the exemplary embodiment, except that a zipper 328 is install in each of left and right sunshield members 118, 160 near their front edge 124, 166, which is attached with stitches 280 to crown 52, and abuts front centerline 74. Zipper 328 has it opening at top edge 126, 168 and is closed near the bottom of each sunshield. The bottom end of the sunshield members is also permanently attached to bottom of crown 52 with stitches 280. The advantages of using a zipper 328 is that, unlike the exemplary embodiment that benefits from a structured front crown portion to line up the front edge 124, 166 of the sunshield members along front centerline 74 neatly, it neatly reattaches the detached portion in a straight line simply by zipping up, and thus enables this shading system in softer crown caps.

The inventor contemplates variations on the shape and dimensions of left and right sunshield members 118, 160. The shape or curvature of front edge 124, 166 thereon may depend on the shape and style of crown 52 that would enable it to abut along front centerline 74 when retracted. Furthermore, bottom edge 122, 164 and top edge 126, 168 may be short if earflaps are not desired, so that the angled folded flap 268, 270 would only serve for retraction purposes, and no fasteners would be provided for earflaps. This may determine the need for having detachable fastening members on crown 52 and rear sunshield member 200 for retracting the angled folded flaps. The length of front edge 124, 166 of left and right sunshield members 118, 160 may also vary depending on how much coverage is desired for the side of the face. The sloping of top edge 126, 168 may vary depending upon the style that is desired. Furthermore, front-top corner 142, 182, rear-top corner 140, 180, and rear-bottom 138, 178 corner may be rounded instead of angled, even to the extent that it is hard to distinguish where one edge ends and another edge begins. The inventor also contemplates different shapes and dimensions for rear sunshield member 200, which would then affect the configuration of the fastening members, attachment locations, and the types of folds needed. For example, if the rear sunshield member 200 is shorter along left and right edge 208, 210, top fold line 254 shown in FIG. 11 may not be required, and the two male snap members 240, 242 could then be disposed above the fold line 224, 226 instead of below it. Sunshield members 118, 160, 200 may have varying number and location of angled folding flaps, and different configuration of fastening members to secure them. Even the same sunshield members 118, 160, 200 herein depicted in drawings may have different number and location of folds and fastening members, with corresponding changes to the configuration of fastening members on the crown. For instance, additional fastening members may be placed along front centerline 74. While the angled folded flaps on the left and right sunshield member 118, 160 should generally be folded extending outward, they may be extended either outward or inward for the rear sunshield member 200. All these variations also leads to different ways in how the angled folded flaps can be attached, either to another sunshield member, to the crown, to the same sunshield member, or a combination thereof. The sunshade cap 40 may use a variety of different fasteners in various combinations instead of just one type of detachable or permanent fastening member. Finally, since a variety of caps may be used with this invention, each of these different style caps may require modifications from their present convention. For example, army fatigue caps usually have a soft front crown portion 56, so it may need to be stiffened with buckram backing 94 to create a smooth surface for retracting the sunshields, unless the alternative embodiment using zippers shown in FIG. 39 is used. The shape of the sunshield members and the configuration of the fastening members should be tailored to suit each type of cap and the specific needs of each cap.

REFERENCE SIGNS LIST

40 sunshade cap; 50 cap body; 52 crown; 54 visor or bill; 56 front crown portion; 58 rear crown portion; 60 left front panel; 62 right front panel; 64 left side panel; 66 right side panel; 68 left rear panel; 70 right rear panel; 72 vertex; 74 front centerline; 76 size adjuster; 78 left crown portion; 80 right crown portion; 82 rear centerline; 84 bottom crown edge; 86 exterior crown surface; 88 interior crown surface; 90 inner sweatband; 92 top sweatband edge; 94 buckram backing; 95 panel seam; 96 seam reinforcement strips; 98*a*, 98*b*, 98*c* female snap member; 100 female snap member; 102*a*, 102*b*, 102*c* female snap member; 104 female snap member; 106*a*, 106*b* female snap member; 108 female snap member; 110 female snap member; 112*a*, 112*b* female snap member; 114 female snap member; 116 female snap member; 118 left sunshield member; 120 first side (of left sunshield member); 122 bottom edge (of left sunshield member); 124 front edge (of left sunshield member); 126 top edge (of left sunshield member); 128 rear edge (of left sunshield member); 130 bias tape binding; 132*a*, 132*b*, 132*c* male snap member; 134 male snap member; 136 front-bottom corner (of left sunshield member); 138 rear-bottom corner (of left sunshield member); 140 rear-top corner (of left sunshield member); 142 front-top corner (of left sunshield member); 144 female snap member; 146 male snap member; 148 third fold line (of left sunshield member); 150 first fold line (of left sunshield member); 152 second fold line (of left sunshield member); 154*a*, 154*b* male snap member; 156 male snap member; 158 second side (of left sunshield member); 160 right sunshield member; 162 first side (of right sunshield member); 164 bottom edge (of right sunshield member); 166 front edge (of right sunshield member); 168 top edge (of right sunshield member); 170 rear edge (of right sunshield member); 172*a*, 172*b*, 172*c* male snap member; 174 male snap member; 176 front-bottom corner (of right sunshield member); 178 rear-bottom corner (of right sunshield member); 180 rear-top corner (of right sunshield member); 182 front-top corner (of right sunshield member); 184 female snap member; 186 male snap member; 188 third fold line (of right sunshield member); 190 first fold line (of right sunshield member); 192 second fold line (of right sunshield member); 194*a*, 194*b* male snap member; 196 male snap member; 198 second side (of right sunshield member); 200 rear sunshield member; 202 first side (of rear sunshield member); 204 bottom edge (of rear sunshield member); 206 top edge (of rear sunshield member); 208 left edge (of rear sunshield member); 210 right edge (of rear sunshield member); 212*a*, 212*b* male snap member; 214*a*, 214*b* male snap member; 216 bottom-left corner (of rear sunshield member); 218 bottom-right corner (of rear sunshield member); 220 top-left corner (of rear sunshield member); 222 top-right corner (of rear sunshield member); 224 left corner fold line (of rear sunshield member); 226 right corner fold line (of rear sunshield member); 228 left-side first fold line (of rear sunshield member); 230 right-side first fold line (of rear sunshield member); 232 female snap member; 234 female snap member; 236 male snap member; 238 male snap member; 240 male snap member; 242 male snap member; 244*a*, 244*b* female snap member; 246*a*, 246*b* female snap member; 248 second side (of rear sunshield member); 250 top-left folded edge (of rear sunshield member); 252 top-right folded edge (of rear sunshield member); 254 top fold line (of rear sunshield member); 256 left-side second fold line (of rear sunshield member); 258 right-side second fold line (of rear sunshield member); 260 left rear folded flap (of rear sunshield member); 262 right rear folded flap (of rear sunshield member); 264 top folded edge (of rear sunshield member); 266 folded flap edge; 268 left side folded flap (of left sunshield member); 270 right side folded flap (of right sunshield member); 272 angle of flap to bottom edge; 274 earflap 276 rear portion (of top edge); 278 bottom-forward corner (of earflap); 280 stitches (for side sunshield member); 282 stitches (for rear sunshield member); 284 front sunshield member; 285 visor sleeve; 286 front portion (of visor sleeve); 288 rear portion (of visor sleeve); 289 sleeve opening; 290 sleeve flap member; 291 front sleeve opening edge; 292 stitches (for sleeve flap member); 293 rear sleeve opening edge; 294 female snap member; 296 female snap member; 298 left end (of front portion of visor sleeve); 300 right end (of front portion of visor sleeve); 302 left end (of rear portion of visor sleeve); 304 right end (of rear portion of visor sleeve); 306 male snap member; 308 male snap member; 310 visor sleeve seam; 312 four sunshield sunshade cap; 314 left strap (of front sunshield member); 316 right strap (of front sunshield member); 318 male snap member; 320 male snap member; 322 female snap member; 324 female snap member; 326 indicia; 328 zipper.

CITATION LIST

Patent Literature

As demonstrative of prior art relevant to background art, reference is made to the following:

U.S. Pat. No. 723,946 to Tobias (1903); U.S. Pat. No. 822,986 to Rochet (1906); U.S. Pat. No. 873,856 to Gordon (1907); U.S. Pat. No. 899,334 to Seitzman (1907); U.S. Pat. No. 1,050,310 to Steinberg et al. (1911); U.S. Pat. No. 1,331,701 to Fendelman (1919); U.S. Pat. No. 2,149,121 to Kronenberger (1939); U.S. Pat. No. D141,256 to Dannenberg (1945); U.S. Pat. No. 2,449,633 to Albert (1948); U.S. Pat. No. 2,462,258 to Dannenberg (1949); U.S. Pat. No. 2,500,982 to Fligel (1950); U.S. Pat. No. 2,844,822 to Persico et al. (1958); U.S. Pat. No. 2,869,134 to Milstein (1959); U.S. Pat. No. 2,878,479 to Schuessler (1959); U.S. Pat. No. 2,897,510 to Forbes-Robinson (1959); U.S. Pat. No. 4,486,903 to Krystal (1984); U.S. Pat. No. 5,035,006 to Hetz et al. (1991); U.S. Pat. No. 5,016,195 to Koritan (1991); U.S. Pat. No. 5,062,163 to Avey (1991); U.S. Pat. No. 5,153,943 to Clement (1992); U.S. Pat. No. 5,201,077 to Dondlinger (1993); U.S. Pat. No. 5,351,343 to Harbison (1994); U.S. Pat. No. 5,493,733 to Pospisil (1996); U.S. Pat. No. 5,623,732 to Olajide Jr. (1997); U.S. Pat. No. 5,694,647 to Crickmore (1997); U.S. Pat. No. 5,694,648 Nucifora (1997);

U.S. Pat. No. D380,591 to Kessel (1997); U.S. Pat. No. 5,790,986 to Hall (1998); U.S. Pat. No. 5,901,380 to Mishal (1999); U.S. Pat. No. 5,956,773 to LaMantia (1999); U.S. Pat. No. 6,079,052 to Veridiano (2000); U.S. Pat. No. 6,081,933 to Partsch, IV (2000); U.S. Pat. Nos. 6,789,268 and 6,802,083 to Yan (2004); U.S. application Ser. No. 11/049,148 by Moshier (2005); U.S. Pat. No. 6,996,852 to Cabrera (2006); U.S. Pat. No. 7,240,372 to Larson (2007); U.S. Pat. No. D599,533 to Yun (2009); U.S. Pat. No. 8,024,818 to Davenport (2011); U.S. Pat. No. 8,051,497 to Erhardt (2011).

Nonpatent Literature

No reference is made to non-patent literature in the description.

The invention claimed is:

1. A sunshade cap, comprising:

(a) a cap body comprising a crown configured for covering the top of a wearer's head, said crown including an exterior crown surface, an interior crown surface; a front crown portion, a rear crown portion, a left crown portion, a right crown portion, a bottom crown edge, a vertex, a front centerline, and a rear centerline;

a visor extending forwardly from the front crown portion adjacent to the bottom crown edge;

(b) a left sunshield member and a right sunshield member made of flexible foldable fabric permanently attached to said crown and configured for shading the left and right side of the wearer's face and being retractable on said crown, said left and right sunshield members being mirror images of each other having a shape, and wherein the left and right sunshield members each include a first side facing outward when retracted onto said crown, a second side facing toward said crown when retracted thereon, a front edge, a top edge, a bottom edge and a rear edge;

(c) a rear sunshield member made of flexible foldable fabric permanently attached to said crown configured for shading the hack of the wearer's neck and ears and being retractable on said crown, said rear sunshield member having a shape, and including a first side facing outward when retracted onto said crown, a second side facing inward toward said crown when retracted thereon, a top edge, a bottom edge, a left edge and a right edge;

(d) a plurality of permanent fastening members that permanently attach at least a portion of the second side of each of said left, right and rear sunshield members adjacent to said left, right, and rear bottom edges respectively onto said exterior crown surface adjacent to said bottom crown edge;

wherein said left sunshield member is attached on a left side of the front crown portion as well as on the left crown portion, and said right sunshield member is attached on a right side of the front crown portion as well as on the right crown portion, and forward of any attaching positions of said rear sunshield member; whereby said left and right sunshield members drape forwardly down a left and a right side respectively of said visor where in said left and right sunshield members are configured to forwardly shade the sides of the wearer's face and cheeks during deployment, and wherein the left and right sunshield members include an angle that is also configured to provide shading to the rear portion of the wearer's face and the ears;

wherein said rear sunshield member is attached on said left and right crown portions and/or on said rear crown portion adjacent to said left and right crown portions respectively, and rearward of any attaching position of said left and right sunshield members on said crown; whereby said rear sunshield member drapes down adjacent to the rear crown portion below the bottom crown edge and is configured to shade the back of the wearer's neck during deployment;

(e) at least one detachable fastening member configured at a position on each of said left and right sunshield members, and a plurality of detachable fastening members configured at positions on said rear sunshield member that secure in a position of retraction at least one angled folded flap formed on and extending outwardly from each of said left and right sunshield members and at least two angled folded flaps formed on and extending either outwardly or inwardly from said rear sunshield member;

wherein at least one detachable fastening member is disposed on an exterior side of each of said at least one angled folded flaps formed on said left and right sunshield members for coupling with at least one of the following: at least one detachable fastening member attached to said left and right sunshield members respectively; at least one detachable fastening member attached to said rear sunshield member; and at least one detachable fastening member attached to said crown;

wherein at least one detachable fastening member is disposed on either an exterior or an interior side of each of said at least, two angled folded flaps formed on said rear sunshield member that couples with at least one of the following: at least one detachable fastening member attached to said rear sunshield member, and at least one detachable fastening member attached to said crown, thereby securing said at least two angled folded flaps in their retracted position;

wherein each of said at least one angled folded flaps on said left and right sunshield members secured by detachable fastening members includes a first fold along a first fold line that starts from a central location of said left and right sunshield members respectively and ends at said rear edge of said left and right sunshield members respectively, and a second fold, folded in an opposite direction of said first fold, along a second fold line located above said first fold line and sharing the same starting focal point as the first fold from the central location and ending at either said top edge of said left and right sunshield members respectively or said rear edge of said left and right sunshield members respectively, so that said first fold forms a flap edge that rises up starting from the focal point at an angle defined by the angle between the first and second fold lines to form an angled folded flap that extends outwardly from said left and right sunshield members, and said second fold serving as an axis that guides said angled folded flap toward its position of retraction secured by detachable fastening members;

wherein two angled folded flaps on said rear sunshield member each secured by detachable fastening members include a first fold either inwardly or outwardly along a first fold line which starts from a central location of said rear sunshield member and ends at either an edge or folded edge of said rear sunshield member, and a second fold along a second fold line located either above or below said first fold line and in the opposite direction of said first fold, and sharing the same starting focal point as the first fold from the central location and ends at an edge or folded edge, wherein the first fold creates a flap edge defined by the angle between the first and second fold line to form an angled folded flap that extends either outwardly or inwardly from said rear sunshield member depending on the direction of the fold, and said second fold serving as an axis that guides said angled folded flap toward its position of retraction secured by detachable fastening members;

(f) a plurality of detachable fastening members attached to said crown within 5.1 cm of the vertex, and a plurality of detachable fastening members attached to said left, right and rear sunshield members, that detachably attach portions of said left, right and rear sunshield members on top of said crown during retraction;

wherein at least one detachable fastening member is disposed on said crown that couples with a corresponding detachable fastening member disposed adjacent to the front edge of each of said left and right sunshield members, so that the front edge of each of said left and right sunshield members is laid along the front centerline on top of said crown and secured near the vertex dining retraction;

wherein at least one detachable fastening member is disposed on said crown that couples with at least one corresponding detachable fastening member disposed on a top portion of said rear sunshield member; wherein the configuration of said detachable fastening members on both said crown and said rear sunshield member holds down and secures one or more folds on said rear sunshield member during retraction.

2. The sunshade cap as defined by claim 1, wherein the at least one corresponding detachable fastening member includes a first set of two corresponding detachable fastening members which are disposed on a top portion of said rear sunshield member to secure multiple folds during retraction, including two folded edges formed by folding a top-left corner and a top-right corner of said rear sunshield member, and wherein the at least one detachable fastening member disposed on said crown includes a second set of two detachable fastening members disposed on said crown which couples with the first set of two corresponding detachable fastening members wherein a third set of two detachable fastening members disposed below and adjacent to each of said two folded edges on said rear sunshield member, when coupled together, form and secure said at least two angled folded flaps that extend inwardly and are tucked in flatly between said exterior crown surface and said rear sunshield member.

3. A sunshade cap, comprising:

(a) a cap body comprising a crown configured for covering the top of a wearer's head, said crown including an exterior crown surface, an interior crown surface, a front crown portion, a rear crown portion, a left crown portion, a right crown portion, a bottom crown edge, a vertex, a front centerline, and a rear centerline;

a visor extending forwardly from the front crown portion adjacent to the bottom crown edge;

(b) a left sunshield member and a right sunshield member made of flexible foldable fabric permanently attached to said crown and configured for shading the left and light side of the wearer's face and being retractable on said crown, said left and right sunshield members being mirror images of each other having a shape, and wherein the left and right sunshield members each include a first side facing outward when retracted onto said crown, a second side facing toward said crown when retracted thereon, a front edge, a top edge, a bottom edge and a rear edge;

(c) a rear sunshield member made of flexible foldable fabric permanently attached to said crown configured for shading the back of the wearer's neck and ears and being retractable on said crown, said rear sunshield member having a shape, and including a first side facing outward when retracted onto said crown, a second side facing inward toward said crown when retracted thereon, a top edge, a bottom edge, a left edge and a right edge;

(d) a plurality of permanent fastening members that permanently attach at least a portion of the second side of each of said left, right and rear sunshield members adjacent to said left, right, and rear bottom edges respectively onto said exterior crown surface adjacent to said bottom crown;

wherein said left sunshield member is attached on a left side of the front crown portion as well as on the left crown portion, and said right sunshield member is attached on a right side of the front crown portion as well as on the right crown portion, and forward of any attaching positions of said rear sunshield member; whereby said left and right sunshield members drape forwardly down a left and a right side respectively of said visor where in said left and right sunshield members are configured to forwardly shade the sides of the wearer's face and cheeks during deployment, and wherein the left and right sunshield members include an angle that is also configured to provide shading to the rear portion of the wearer's face and the ears;

wherein said rear sunshield member is attached on said left, and right crown portions and/or on said rear crown portion adjacent to said left and right crown portions respectively, and rearward of any attaching position of said left and right sunshield members on said crown; whereby said rear sunshield member drapes down adjacent to the rear crown portion below the bottom crown edge and is configured to shade the back of the wearer's neck during deployment;

(e) at least one detachable fastening member configured at a position on each of said left and right sunshield members, and a plurality of detachable fastening members configured at positions on said rear sunshield member that secure in a position of retraction at least one angled folded flap formed on and extending outwardly from each of said left and right sunshield members and at least two angled folded flaps formed on and extending either outwardly or inwardly from said rear sunshield member;

wherein each of the bottom edges of said left sunshield member and said right sunshield member create each of said at least one angled folded flaps formed on and extending outwardly from each of said left and right sunshield members that, when retracted horizontally, have a portion thereof extending onto said rear sunshield member and the rear crown portion, and the sunshade cap further comprises at least one detachable fastening member on said rear sunshield member on the first side and at least one detachable fastening member on the rear crown portion, for coupling with at least one detachable fastening member on the exterior side of each of the at least one angled folded flaps, so that the at least one angled folded flaps are capable of being secured in the position of retraction on the cap body when said rear sunshield member is either deployed or retracted;

wherein at least one detachable fastening member is disposed on either an exterior or an interior side of each of said at least two angled folded flaps formed on said rear sunshield member that couples with at least one of the following: at least one detachable fastening member attached to said rear sunshield member, and at least one detachable fastening member attached to said crown, thereby securing said at least two angled folded flaps in their retracted position;

(f) a plurality of detachable fastening members attached to said crown within 5.1 cm of the vertex, and a plurality of detachable fastening members attached to said left, right and rear sunshield members, that detachably attach portions of said left, right and rear sunshield members on top of said crown during retraction;

wherein at least one detachable fastening member is disposed on said crown that couples with a corresponding detachable fastening member disposed adjacent to the front edge of each of said left and right sunshield members, so that the front edge of each of said left and right sunshield members is laid along the front centerline on top of said crown and secured near the vertex during retraction;

wherein at least one detachable fastening member is disposed on said crown that couples with at least one corresponding detachable fastening member disposed on a top portion of said rear sunshield member; wherein the configuration of said detachable fastening members on both said crown and said rear sunshield member holds down and secures one or more folds on said fear sunshield member during retraction.

4. The sunshade cap as defined by claim 3, wherein the at least one corresponding detachable fastening member includes a first set of two corresponding detachable fastening members which are disposed on a top portion of said rear sunshield member to secure multiple folds during retraction, including two folded edges formed by folding a top-left corner and a top-right corner of said rear sunshield member, and wherein the at least one detachable fastening member disposed on said crown includes a second set of two detachable fastening members disposed on said crown which couples with the first set of two corresponding detachable fastening members wherein a third set of two detachable fastening members disposed below and adjacent to each of said two folded edges on said rear sunshield member, when coupled together, form and secure said at least two angled folded flaps that extend inwardly and are tucked in flatly between said exterior crown surface and said rear sunshield member.

* * * * *